US006176399B1

(12) United States Patent
Schantz et al.

(10) Patent No.: US 6,176,399 B1
(45) Date of Patent: Jan. 23, 2001

(54) VALVED DISPENSING SYSTEM FOR MULTIPLE DISPENSING STREAMS

(75) Inventors: Daniel G. Schantz, Muskego, WI (US); Timothy R. Socier, Essexville, MI (US); Richard A. Gross, Oconomowoc, WI (US)

(73) Assignee: AptarGroup, Inc, Crystal Lake, IL (US)

( * ) Notice: Under 35 U.S.C. 154(b), the term of this patent shall be extended for 0 days.

(21) Appl. No.: 09/352,172

(22) Filed: Jul. 12, 1999

(51) Int. Cl.[7] ..... B67D 3/00
(52) U.S. Cl. ..... 222/484; 222/494
(58) Field of Search ..... 222/490, 494, 222/232, 212, 484, 482, 481; 220/259, 485, 488; 251/342, 349; 239/562, 568

(56) References Cited

U.S. PATENT DOCUMENTS

| | | | | |
|---|---|---|---|---|
| 1,122,868 | * | 12/1914 | Davis | 222/490 |
| 4,728,006 | * | 3/1988 | Drobish et al. | 222/494 |
| 4,830,231 | * | 5/1989 | Smith | 222/490 |
| 5,115,950 | | 5/1992 | Rohr . | |
| 5,271,531 | | 12/1993 | Rohr et al. . | |
| 5,676,289 | * | 10/1997 | Gross et al. | 222/494 |
| 5,680,969 | | 10/1997 | Gross . | |
| 5,730,336 | * | 3/1998 | Lerner | 222/490 |
| 5,839,614 | | 11/1998 | Brown . | |
| 5,839,626 | | 11/1998 | Gross et al. . | |
| 5,873,494 | | 2/1999 | Dallas, Jr. . | |

* cited by examiner

*Primary Examiner*—Kevin Shaver
*Assistant Examiner*—Melvin A. Cartagena
(74) *Attorney, Agent, or Firm*—Rockey, Milnamow & Katz, Ltd.

(57) ABSTRACT

A dispensing system is provided and can be embodied in a dispensing closure for a container having an opening. The system includes a unitary, resiliently flexible, molded valve array structure for being sealingly disposed on the container over the container opening. The valve array structure includes an impervious membrane. The valve array structure also includes a plurality of resiliently flexible, slit valves molded unitary with the membrane. Each valve has a normally closed dispensing orifice which opens when the pressure in the interior of the container exceeds the pressure on the exterior of the valve by a predetermined amount. The valves can be arranged to discharge parallel streams, diverging streams, or converging streams.

36 Claims, 27 Drawing Sheets

VALVED DISPENSING SYSTEM FOR MULTIPLE DISPENSING STREAMS

CROSS REFERENCE TO RELATED APPLICATION(S)

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present invention relates to a system for dispensing a product from a container. The system is especially suitable for use in, or as a dispensing closure for, a flexible container which is squeezable.

BACKGROUND OF THE INVENTION AND TECHNICAL PROBLEMS POSED BY THE PRIOR ART

There are a wide variety of packages which include (1) a container, (2) a dispensing system extending as a unitary part of, or attachment to, the container, and (3) a product contained within the container. One type of such a package employs a single dispensing valve for discharging a single stream of product (which may be a liquid, cream, or particulate product). See, for example, U.S. Pat. No. 5,839,614 assigned to AptarGroup, Inc. The package includes a flexible, resilient, slit-type valve at one end of a generally flexible bottle or container. The valve is normally closed and can withstand the weight of the product when the container is completely inverted, so that the product will not leak out unless the container is squeezed.

In some applications, it may be desirable to dispense the product in multiple streams rather than a single stream. For example, it may be desirable to spray liquid from the dispensing system in a spray pattern. It may be desirable to provide a spray pattern that is fan-shaped or conical. It may also be desirable to provide a spray pattern that is substantially straight (i.e., defining a spray confined within a substantially cylindrical envelope). It may also be desirable to provide a dispensing pattern of separate streams that substantially converge to a small target area beyond the package.

It would be beneficial if an improved dispensing system could be provided to accommodate such multiple stream dispensing of a product through a structure that could be relatively readily manufactured and installed in the package.

Such an improved dispensing system should also facilitate ease of dispensing the product when the interior of the container is pressurized (e.g., when the container is squeezed or when the container internal pressure is increased by other means).

It would also be advantageous if such an improved system could accommodate bottles, containers, or packages or have a variety of shapes and that are constructed from a variety of materials.

Further, it would be desirable if such an improved system could accommodate efficient, high-quality, large-volume manufacturing techniques with a reduced product reject rate to produce a system with consistent operating characteristics.

The present invention provides an improved valved dispensing system which can accommodate designs having the above-discussed benefits and features.

BRIEF SUMMARY OF THE INVENTION

The present invention provides a system for dispensing a product from a container to provide multiple discharge streams. The system can accommodate discharge of liquids, creams, or particulate matter, including powders.

The dispensing system is adapted for use in dispensing a product from a container having an opening. The dispensing system may be formed as a unitary part of an end of such a container or may be a separate assembly that is permanently or releasably attached to the container.

The dispensing system includes a unitary, resiliently flexible, molded valve array structure for being sealingly disposed on the container over the container opening. The valve array structure includes an impervious membrane. The valve array structure also includes a plurality of resiliently flexible, slit valves molded unitary with the membrane. Each valve has a normally closed dispensing orifice which opens when the pressure in the interior of the container exceeds the pressure on the exterior of the valve by a predetermined amount. In a preferred embodiment, the membrane material is a molded, thermosetting elastomer, and the orifice is defined by two mutually perpendicular slits in the membrane material.

In one presently contemplated embodiment, the valve array structure includes three valves arranged equidistantly from one another. The valve array structure is releasably attached to the container with an exterior housing which is threadably engaged or snap-fit engaged with a container around the container opening.

The present invention operates to simultaneously dispense two or more streams of product from the container. The dispensing system of the present invention can be designed so that the streams diverge, converge, or remain substantially parallel.

If desired, a hinged or removable cap or lid can be provided over the dispensing valves. Further, a liner, removable label, or other such structure may be initially provided over the valves to prevent leakage from the package if the package is subjected to squeezing forces during shipping and handling.

The dispensing system can employ valves which are self-sealing and are biased to close when the pressure differential across the open valve drops below a predetermined amount. Alternatively, the dispensing system can employ a valve which, once opened, remains opened even if the pressure differential across the valve drops to zero. Further, the dispensing structure of the present invention can accommodate different types of valves, as well as different sizes of valves, within one valve array structure.

Numerous other advantages and features of the present invention will become readily apparent from the following detailed description of the invention, from the claims, and from the accompanying drawings.

BRIEF DESCRIPTION OF THE DRAWINGS

In the accompanying drawings that form part of the specification, and in which like numerals are employed to designate like parts throughout the same.

DETAILED DESCRIPTION

While this invention is susceptible of embodiment in many different forms, this specification and the accompanying drawings disclose only some specific forms as examples of the invention. The invention is not intended to be limited to the embodiments so described, however. The scope of the invention is pointed out in the appended claims.

For ease of description, the dispensing system of this invention is described in the typical orientation that it would have at the top of a container when the container is stored upright on its base, and terms such as upper, lower, horizontal, etc., are used with reference to this position. It will be understood, however, that the dispensing system of this invention may be manufactured, stored, transported, used, and sold in an orientation other than the position described.

The dispensing system of this invention is suitable for use with a variety of conventional or special containers having various designs, the details of which, although not illustrated or described, would be apparent to those having skill in the art and an understanding of such containers. The container per se forms no part of the present invention.

Figure 1:
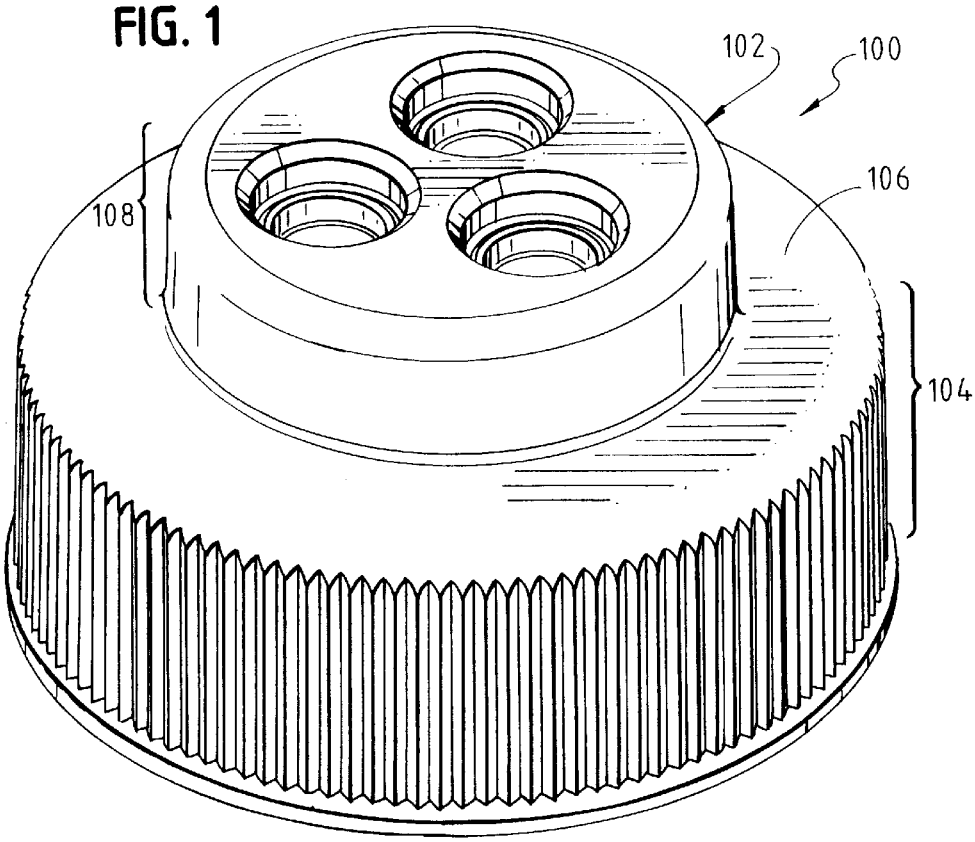
FIG. 1 is a perspective view of a first embodiment of the dispensing system of the present invention incorporated in a dispensing closure which is formed separately from, and which is adaptable to be releasably mounted to, a container which has an opening to the container interior.
Figure 2:
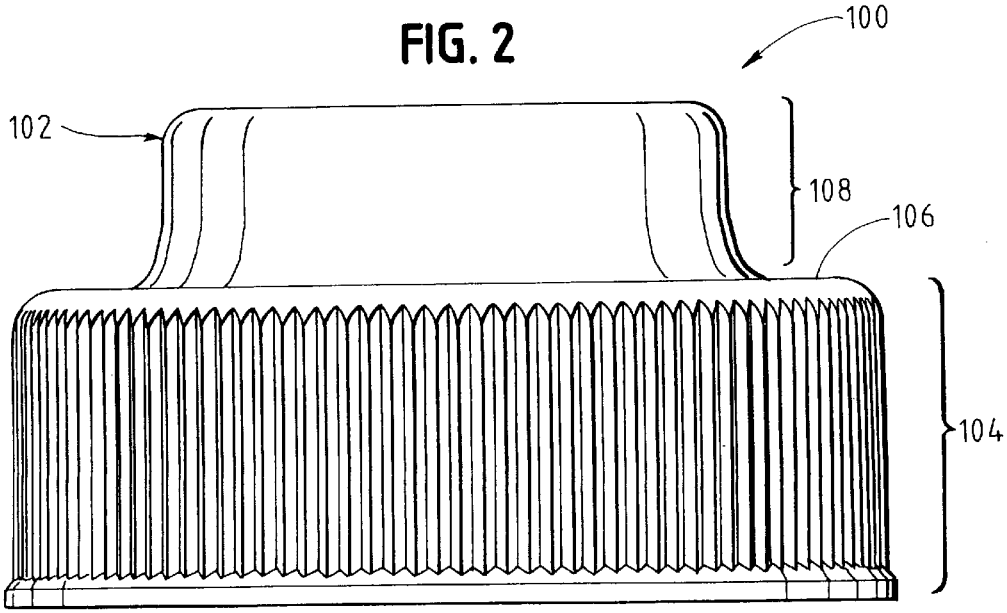
FIG. 2 is a side elevational view.
Figure 3:
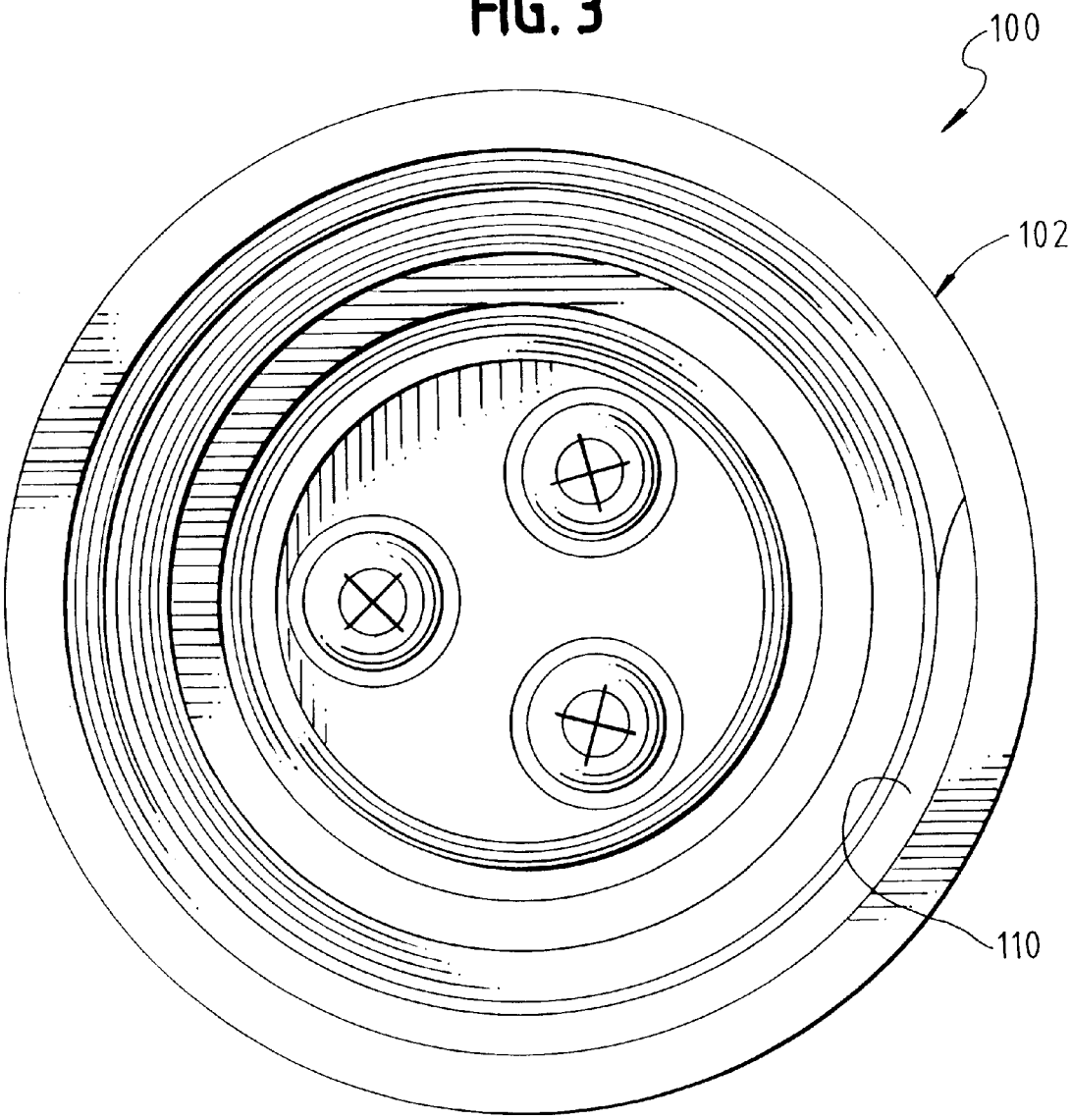
FIG. 3 is a bottom plan view.

The first embodiment of the dispensing system of the invention is illustrated in FIGS. 1–15 in the form of a dispensing closure 100 for a container (not illustrated). As can be seen in FIG. 2, the closure 100 has a body or housing 102 which includes a base or skirt 104, an annular shoulder 106 extending radially inwardly from the top of the skirt 104, and a reduced diameter spout 108 extending upwardly from the inner portion of the shoulder 106.

Figure 5:
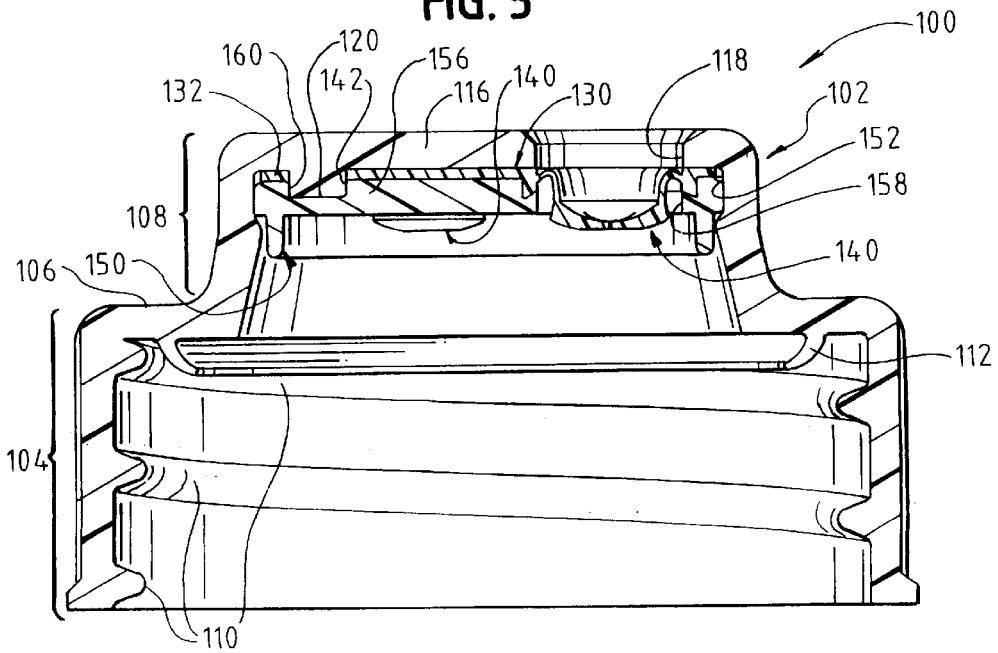
FIG. 5 is a cross-sectional view taken generally along the plane 5—5 in FIG. 4.

As can be seen in FIG. 5, the interior of the skirt 104 defines a thread 110. The skirt 104 is adapted to receive the upper end of a container mouth or neck (not illustrated). The skirt thread 110 is adapted to matingly engage a thread on the container mouth or neck.

Alternatively, the closure having skirt 104 could be provided with some other container connecting means, such as a snap-fit bead (not illustrated) in place of the thread 110 for engaging a mating groove (not illustrated) in the container neck. The closure body or housing 102 could also be permanently fixed to the container by means of induction melting, ultrasonic melting, gluing, or the like, depending on the materials used for the closure body or housing 102 and the container. The closure housing 102 could also be formed as a unitary part, or extension, of the container.

The closure housing skirt 104 may have any suitable configuration. The container could have an upwardly projecting neck or other portion for being received within the particular configuration of the closure housing, and the main part of the container may have a different cross-sectional shape than the container neck and closure housing skirt 104.

The closure 100 is adapted to be used with a container having a mouth or other opening to provide access to the container interior and to a product contained therein. The product may be, for example, a liquid comestible product. The product could also be any other liquid, solid, or gaseous material, including, but not limited to, a powder, a food product, a personal care product, an industrial or household cleaning product, or other chemical compositions (e.g., compositions for use in activities involving manufacturing, commercial or household maintenance, construction, agriculture, etc.).

The container would typically be a squeezable container having a flexible wall or walls which can be grasped by the user and squeezed or compressed to increase the internal pressure within the container so as to force the product out of the container and through the closure 100. The container wall typically has sufficient, inherent resiliency so that when the squeezing forces are removed, the container wall returns to its normal, unstressed shape. Such a squeezable wall structure is preferred in many applications but may not be necessary or preferred in other applications. For example, in some applications it may be desirable to employ a generally rigid container and pressurize the container interior at selected times with a piston or other pressurizing system.

An annular, "crab's claw" seal 112 projects downwardly from the underside of the body shoulder 106 as can be seen in FIG. 5. The seal 112 is adapted to sealingly engage the inside, annular edge of the container (not illustrated) on which the closure 100 is mounted.

Figure 6:
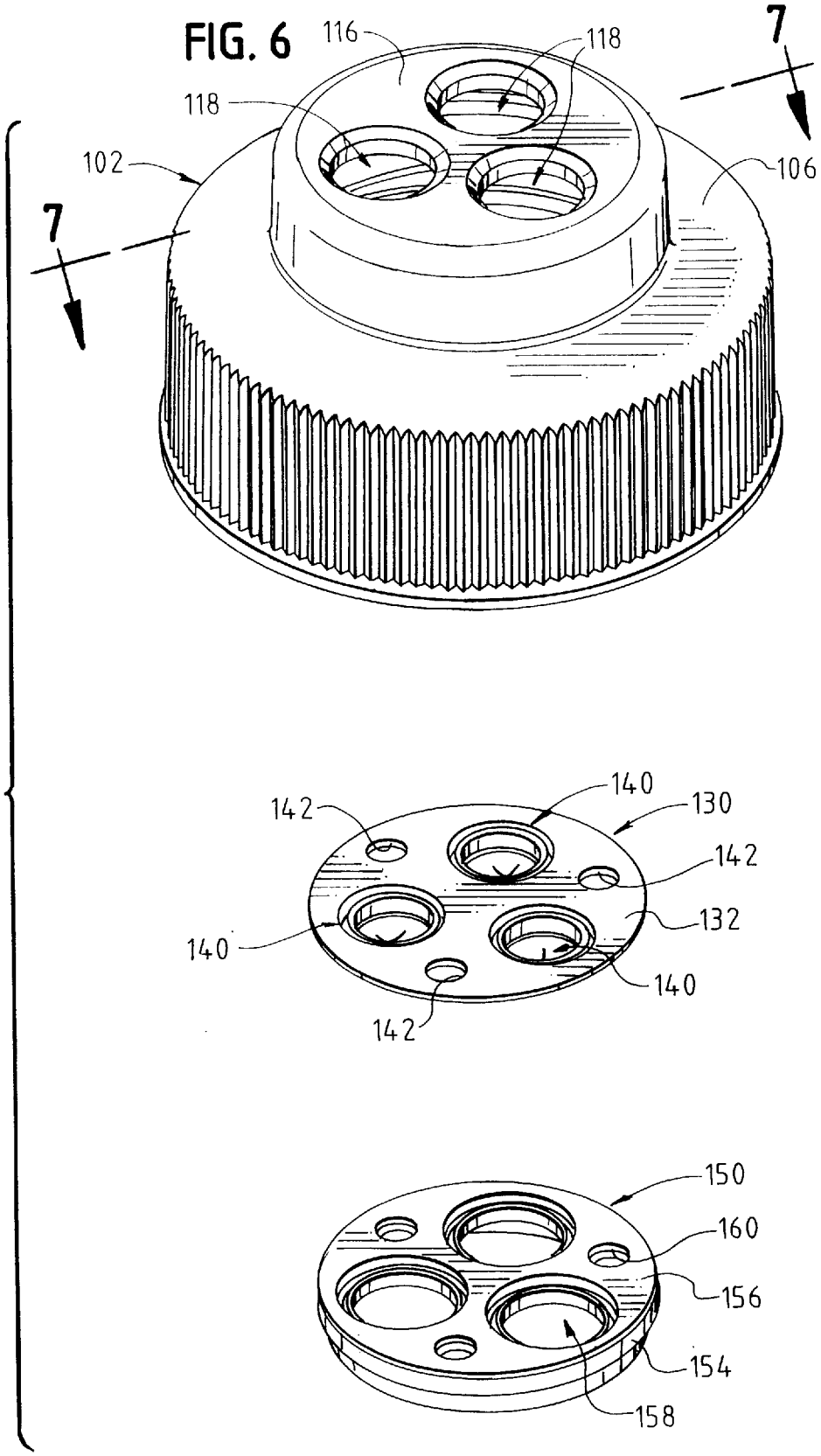
FIG. 6 is an exploded, perspective view.
Figure 7:
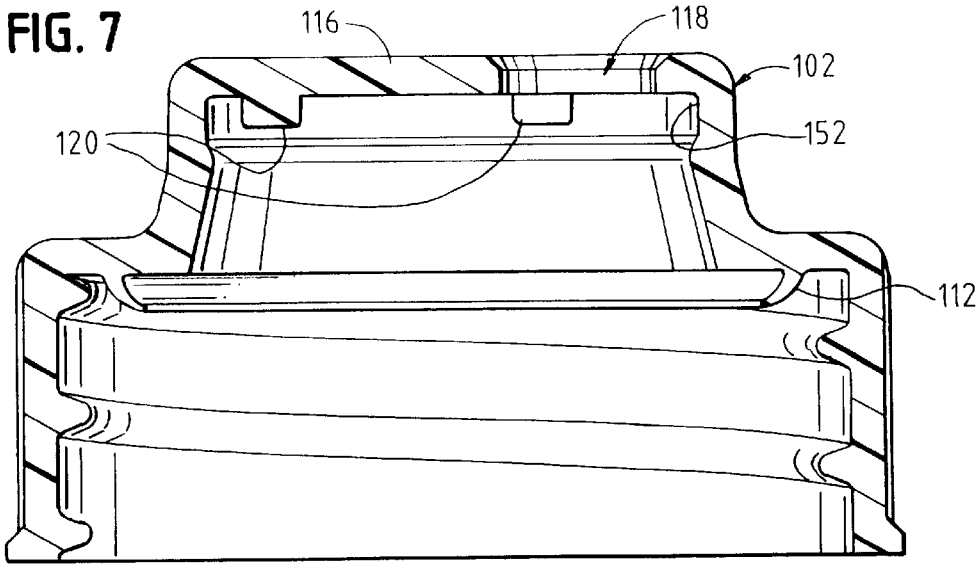
FIG. 7 is a cross-sectional view of the closure housing taken generally along the plane 7—7 in FIG. 6.

The closure body or housing 102 includes an upper, central, end wall 116 defining a plurality of circular openings 118 as can be seen in FIGS. 6 and 7. In the preferred first embodiment illustrated in FIGS. 1–15, there are three circular openings 118 which are arranged equidistantly from one another. A small, generally annular, marginal region of the end wall 116 circumscribes the three openings 118.

As can be seen in FIG. 7, there are a plurality of projections 120 which extend downwardly from the underside of the central end wall 116. Two such projections 120 are visible in FIG. 7. Preferably, three such projections 120 are provided in the closure body or housing 102 and are arranged equidistantly from each other on the underside of the central end wall 116. Each projection 120 is located so that it is equidistant from two adjacent openings 118 in the central end wall 116.

The dispensing closure body or housing 102 is preferably molded from a thermoplastic material such as polypropylene to form a generally rigid, hard, plastic structure. The particular material from which the housing or body 102 is made forms no part of the present invention.

Figure 8:
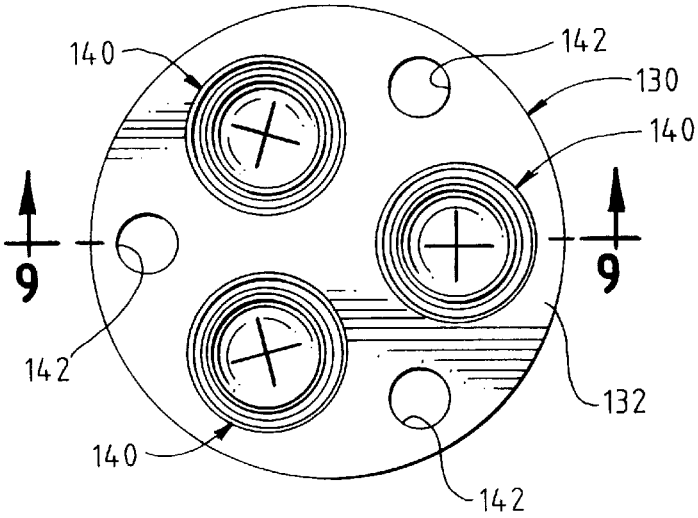
FIG. 8 is a top plan view of the valve pad or molded valve array structure.

With reference to FIGS. 6 and 8, the dispensing closure further includes a valve array structure 130. The valve array structure 130 is a unitary, resiliently flexible, molded structure which is preferably molded from a thermosetting elastomeric material, such as silicone rubber, natural rubber, and the like. The valve array structure 130 could also be molded from a thermoplastic elastomer. Preferably, the valve array structure 130 is molded from silicone rubber, such as the silicone rubber sold by The Dow Chemical Company in the United States of America under the trade designation DC-595.

The valve array structure 130 includes an impervious membrane 132 in which are located (1) a plurality of resiliently flexible, slit valves 140 which are each molded unitary with the membrane 132, and (2) a plurality of apertures 142. In the preferred, first embodiment illustrated in FIGS. 1–15, there are three valves 140 located in a generally planar array to dispense product from the container along generally parallel discharge paths. In the embodiment illustrated in FIGS. 1–15, the valves 140 all have an identical configuration and size. In the illustrated first embodiment, the three valves 140 arranged equidistantly from one another, and the membrane 132 includes a peripheral, annular region which lies radially beyond, and circumscribes, the valves 140 to define a generally circular, outer edge.

Figure 4:
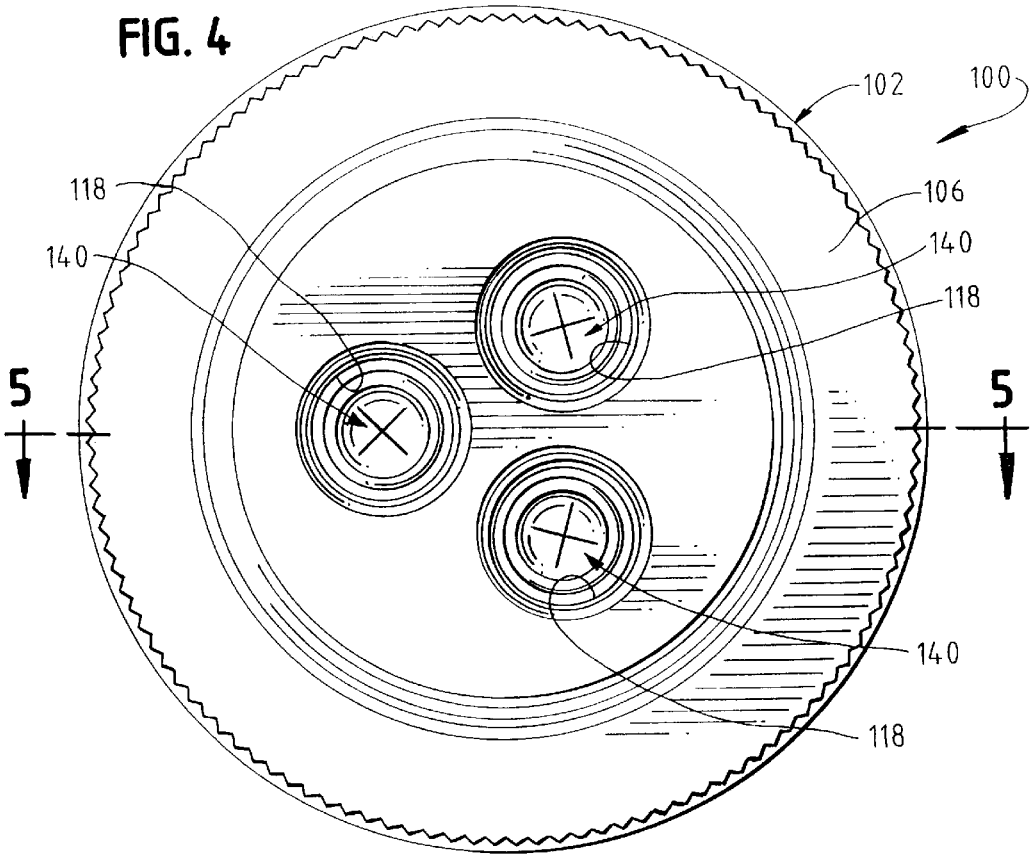
FIG. 4 is a top plan view.

Each aperture 142 in the membrane 132 is adapted to receive one of the projections 120 extending downwardly from the underside of the closure housing central end wall 116. This establishes a keyed relationship between the housing 102 and the valve array structure 130 to provide a predetermined orientation of the housing openings 118 with the valves 140 to define an aligned registration of the housing openings 118 with the valves 140 as can be seen in FIGS. 4 and 5.

The valve array structure 130 is retained within the housing 102 by means of a retainer 150 engaged with the housing 102 (FIGS. 5 and 6). The housing 102 defines an annular channel 152 (FIG. 7), and as shown in FIG. 5, a portion of the retainer 150 is received within the channel 152. To this end, the retainer 150 includes a peripheral portion 154 (FIG. 14) which is adapted to be received in the housing channel 152 in a snap-fit engagement.

The retainer 150 includes a support deck 156 for supporting the membrane 132 of the valve array structure 130. The support deck 156 defines a plurality of circular opening 158 which are each adapted for receiving a downwardly projecting portion of one of the valves 140 (FIG. 5).

The retainer 150 also defines a plurality of recesses 160 (FIGS. 13 and 14) for each receiving the distal end of one of the housing projections 120 to establish a keyed relationship between the retainer 150, the valve array structure 130, and the housing 102.

In a presently preferred embodiment, the retainer 150 is molded from a thermoplastic material such as polypropylene. The retainer 150 and/or the housing 102 are sufficiently deflectable to accommodate insertion of the retainer 150 into the housing 102 so as to effect the snap-fit engagement of the retainer peripheral portion 154 in the housing annular channel 152.

Figure 14:
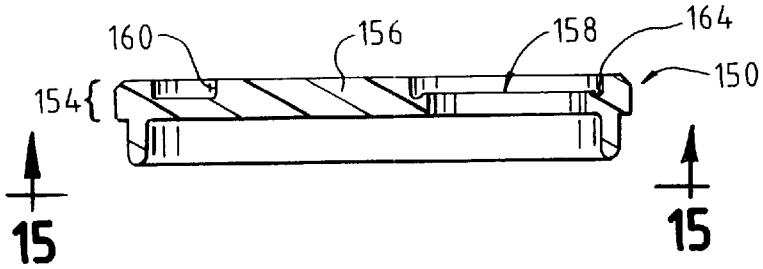
FIG. 14 is a cross-sectional view taken generally along the plane 14—14 in FIG. 13.
Figure 15:
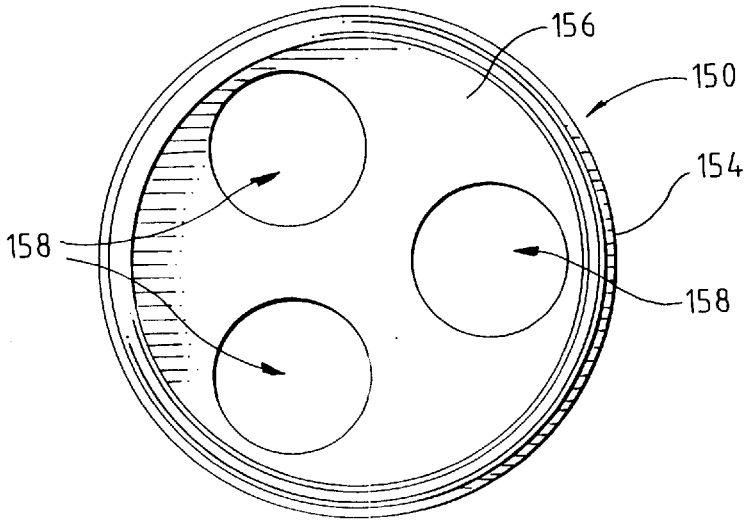
FIG. 15 is a bottom plan view taken generally along the plane 15—15 in FIG. 14.
Figure 16:
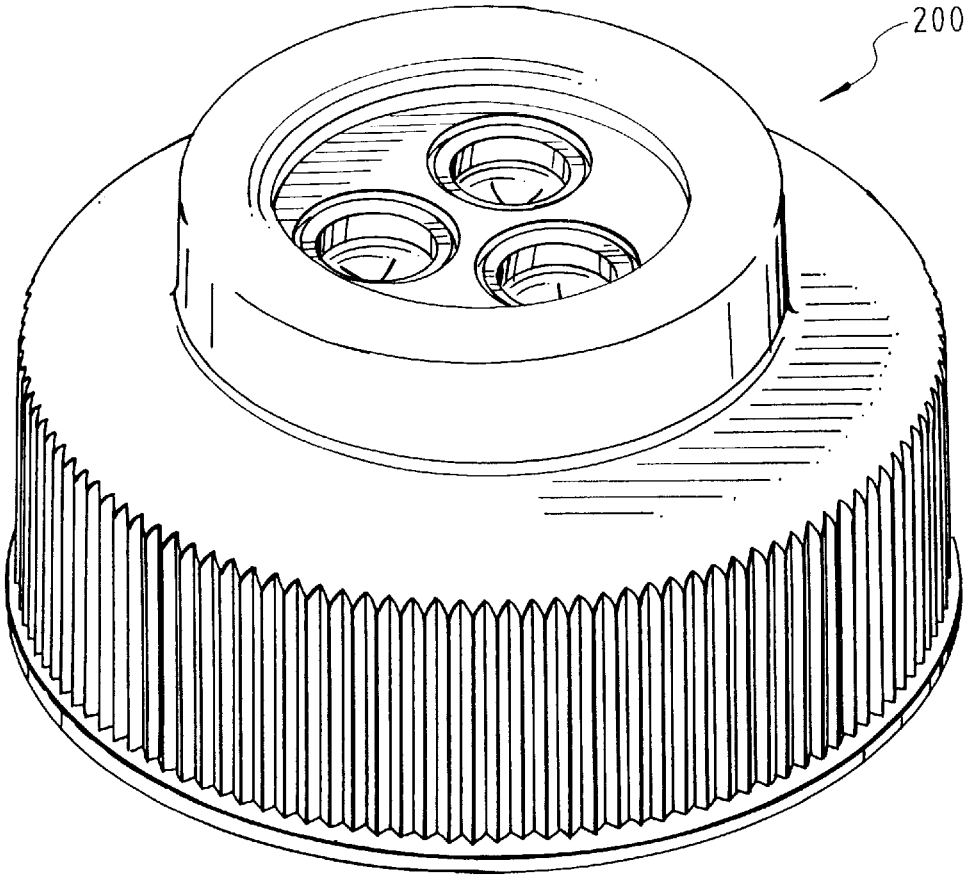
FIG. 16 is a perspective view of a second embodiment of the dispensing system of the present invention incorporated in a dispensing closure which is formed separately from, and which is adaptable to be releasably mounted to, a container which has an opening to the container interior.
Figure 17:
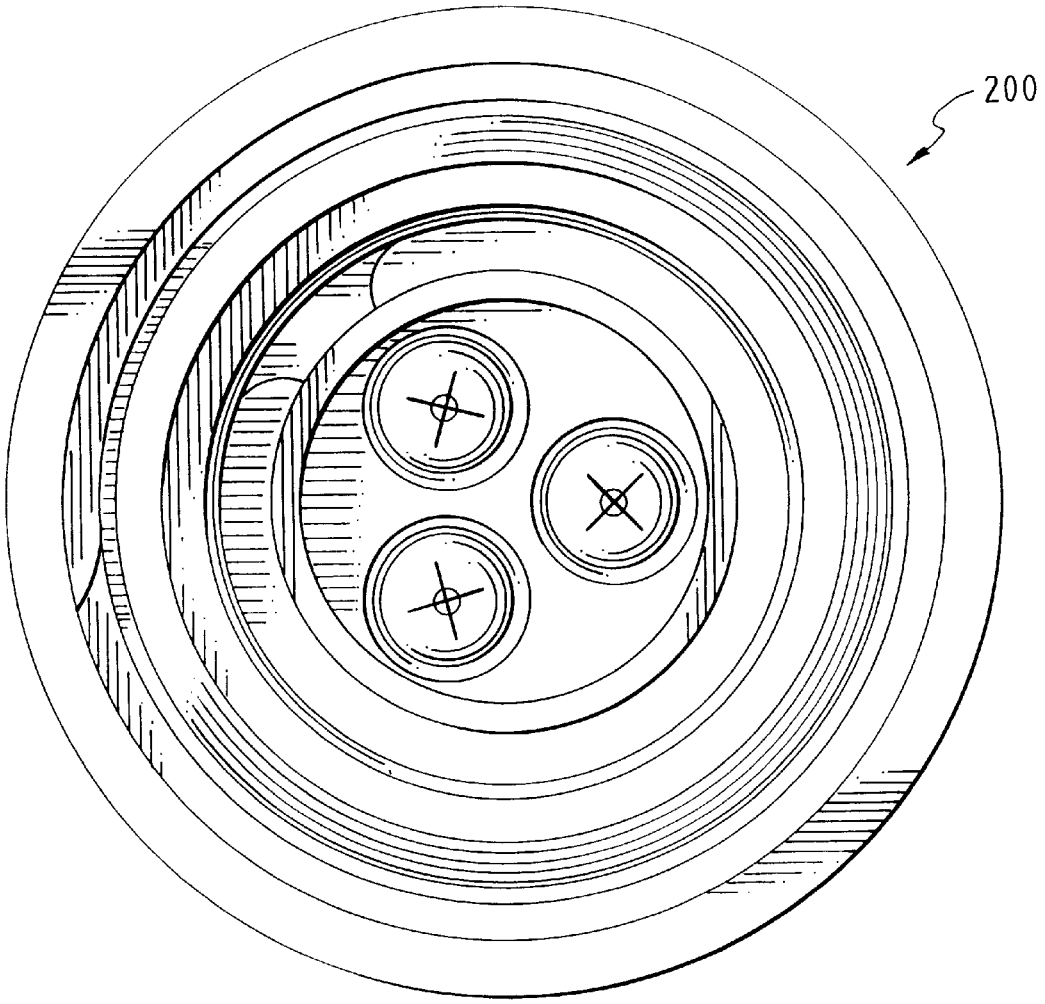
FIG. 17 is a bottom plan view of the second embodiment of the closure shown in FIG. 16.
Figure 18:
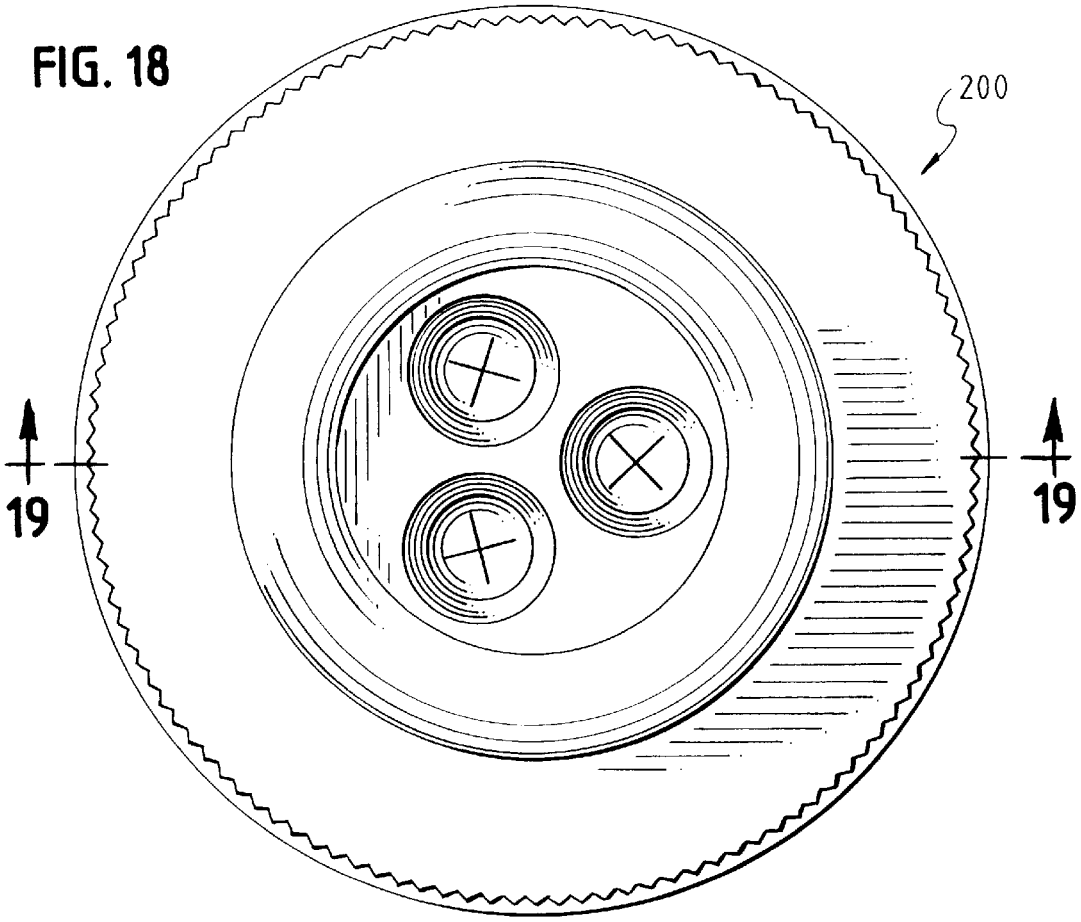
FIG. 18 is a top plan view of the second embodiment of the closure shown in FIG. 16.

With reference to FIG. 14, it can be seen that the retainer 150 defines a frustoconical seating surface 164 at the periphery of each valve-receiving opening 158. This accommodates the engagement with a mating, frustoconical surface 168 (FIG. 9) around the periphery of each valve 140.

Each valve 140 is a resiliently flexible, slit valve. Pressure on the interior side of the valve will cause the valve to open when the differential between the interior and exterior pressure reaches a predetermined amount. Depending on the particular design, the valve may close when the pressure differential decreases, or the valve may stay open even if the pressure differential decreases to zero. In the preferred embodiment of the valve 140 illustrated for the first embodiment of the system shown in FIGS. 1–15, the valve has the design that closes when the pressure differential decreases to a predetermined amount.

In the preferred embodiment illustrated, each valve 140 has the configuration and operating characteristics of a commercially available valve design substantially as disclosed in the U.S. Pat. No. 5,676,289 with reference to the valve 46 disclosed in the U.S. Pat. No. 5,676,289. The operation of such a type of valve is further described with reference to the similar valve that is designated by reference number 3*d* in the U.S. Pat. No. 5,409,144. The descriptions of those two patents are incorporated herein by reference to the extent pertinent and to the extent not inconsistent herewith.

Figure 11:
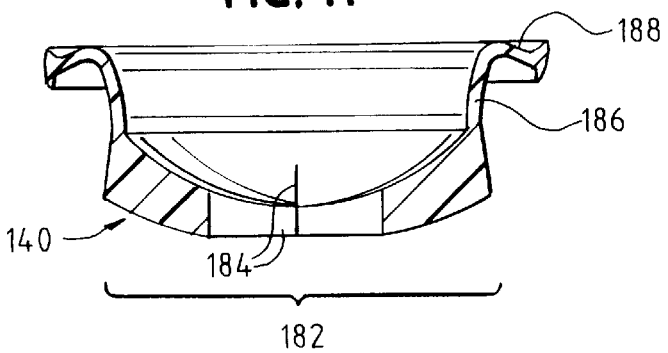
FIG. 11 is a greatly enlarged, fragmentary, cross-sectional view of the right-hand valve in the valve array structure shown in FIG. 9.
Figure 12:
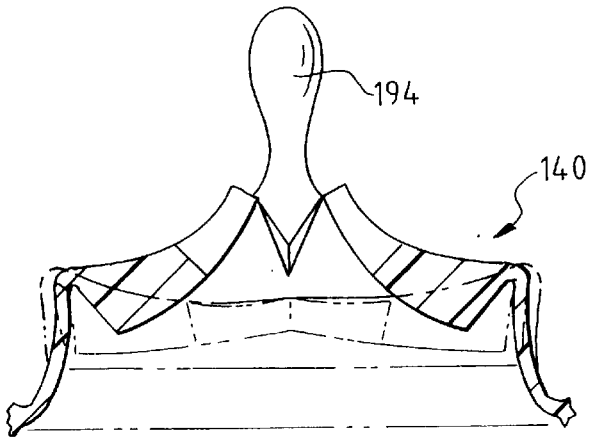
FIG. 12 is a view similar to FIG. 11, but FIG. 12 shows the valve in a substantially fully open configuration dispensing a product which is pressurized from an interior region below the valve.
Figure 13:
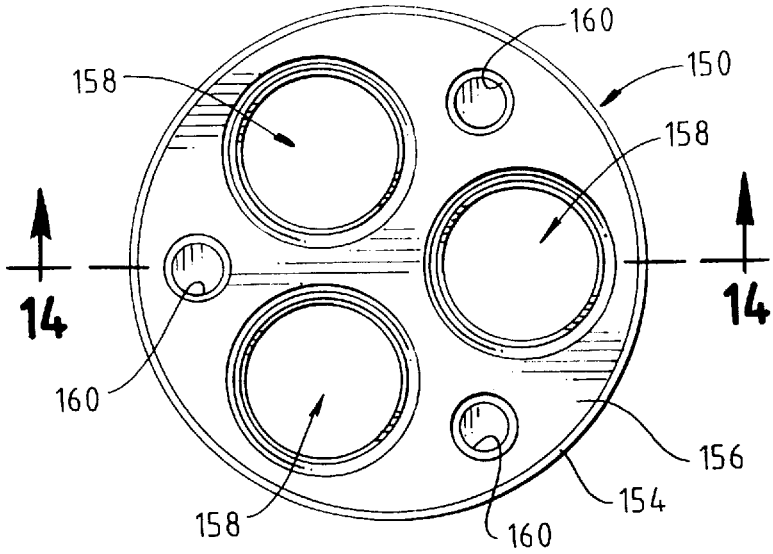
FIG. 13 is a top plan view of the retainer.

As illustrated in FIGS. 11 and 12 herein, each valve 140 includes a flexible, head portion or central wall 182 which has an outwardly concave configuration and which defines at least one, and preferably two, dispensing slits 184 extending through the head portion or central wall 180. A preferred form of the valve 180 has two, mutually perpendicular, intersecting slits 184 of equal length. The intersecting slits 184 define four, generally sector-shaped, flaps or petals in the concave, central wall 182. The flaps open outwardly from the intersection point of the slits 184 in response to increasing pressure of sufficient magnitude in the well-known manner described in the above-discussed U.S. Pat. No. 5,409,144.

Figure 9:
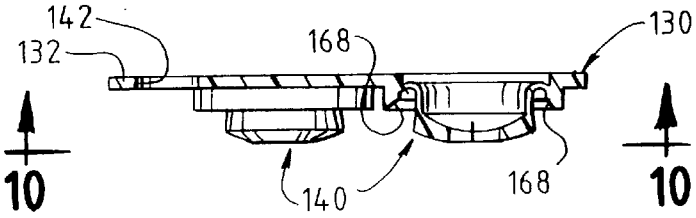
FIG. 9 is a cross-sectional view taken generally along the plane 9—9 in FIG. 8.
Figure 10:
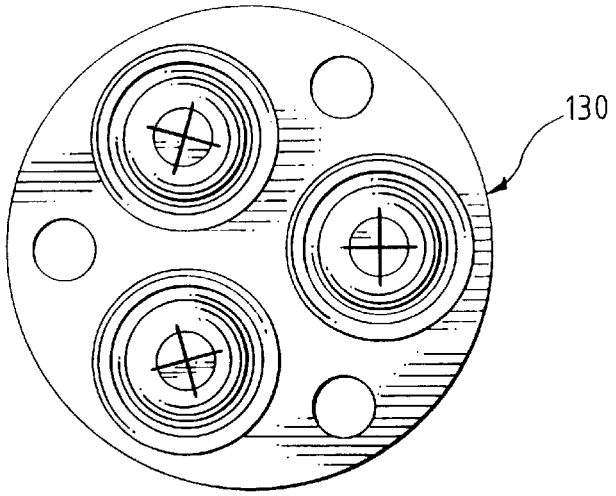
FIG. 10 is a bottom plan view taken generally along the plane 10—10 in FIG. 9.

The valve 180 includes a skirt 186 (FIGS. 11 and 12) which extends outwardly from the valve head portion or central wall 182. At the outer (upper) end of the skirt 186 there is a thin, annular flange 188 (FIGS. 11 and 12) which extends peripherally from the skirt 186 in a downwardly angled orientation. The thin flange 188 terminates in the surrounding membrane 132 with a surrounding flat, top surface and has a downwardly projecting thicker part defining the frustoconical surface 168 on the bottom (FIG. 9).

When the valve 140 is properly disposed with the housing 102 in the closed condition (FIG. 5), the valve 140 is recessed relative to the top of the housing 102. However, when a person squeezes the container (not illustrated) below the valve, the valve central wall 182 is forced outwardly from its recessed position, and liquid flows through the valve 140. More specifically, when the pressure below the valve 140 exceeds the external ambient pressure by a predetermined amount, the valve 140 is forced outwardly from the recessed or retracted position to an extended, open position as shown in FIG. 12. The valve central wall 182 (which contains the slits 184) is initially displaced outwardly while still maintaining its generally concave configuration (shown in phantom by dashed lines in FIG. 12). The outward displacement of the concave, central wall 182 is accommodated by the relatively, thin, flexible, skirt 186. The skirt 186 moves from a recessed, rest position to the pressurized position wherein the skirt 186 is projecting outwardly toward the open end of the housing 102.

The valve 140 does not open (i.e., the slits 184 do not open) until the valve central wall 182 has moved substantially all the way to a fully extended position. Indeed, as the valve central wall 182 moves outwardly, the valve central wall 182 is subjected to radially inwardly directed compression forces which tend to further resist opening of the slits 184 as shown in phantom in dashed lines in FIG. 12. Further, the valve central wall 182 generally retains its outwardly concave configuration as it moves forward and even after it reaches the fully extended position. However, if the internal pressure is sufficiently great compared to the external pressure, then the slits 184 of the extended valve 140 begin to open to dispense product (in a continuous stream or stream of drops 194 (FIG. 12) if the product is a liquid).

When the three valves 140 are each located in a generally planar array as illustrated for the first embodiment in FIGS. 1–15, the product is discharged through each of the valves 140 substantially as three parallel continuous or discontinuous streams. In other contemplated embodiments, the housing central wall 116, the valve array structure 130, and the retainer 150 could each be generally non-planar, such as convex or concave as viewed from the exterior of the package. A concave configuration would result in the multiple streams being generally focused inwardly toward a reduced diameter target area at some distance from the end of the package. A convex configuration would result in a outwardly flaring, or conical, spray pattern.

If desired, the closure housing 102 may be provided with an attached, or completely removable, lid (not illustrated). The lid may be hinged with a conventional or special snap-action hinge, or the lid may simply be tethered to the housing. The lid may also include inwardly extending plugs or members for being received in the concave region of each valve 140 as a means for preventing the valves 140 from opening during shipping and handling when the packages could be subjected to exterior forces that could cause internal, transient pressure increases that might otherwise open the valves.

In still another contemplated modification, a releasable liner or removable label (not illustrated) could be initially attached across the top of the housing 102 to the exterior surface of the central end wall 116. This would also prevent discharge of product from the valves 140 during shipping and handling when the packages are subjected to external impact forces or squeezing forces. Once such lids or removable liners have been removed by the user, they could be saved by the user and re-applied to the top of the closure when the user subsequently wants to stow the package in luggage while travelling. This would prevent the product from being discharged from the package if the package is subjected to external impact forces causing transient pressure increases in the package.

FIGS. 16–29 illustrate a second embodiment of the dispensing system of the present invention. The second embodiment is also in the form of a dispensing closure which is designated generally by the reference number 200 in FIGS. 16–29.

Figure 22:
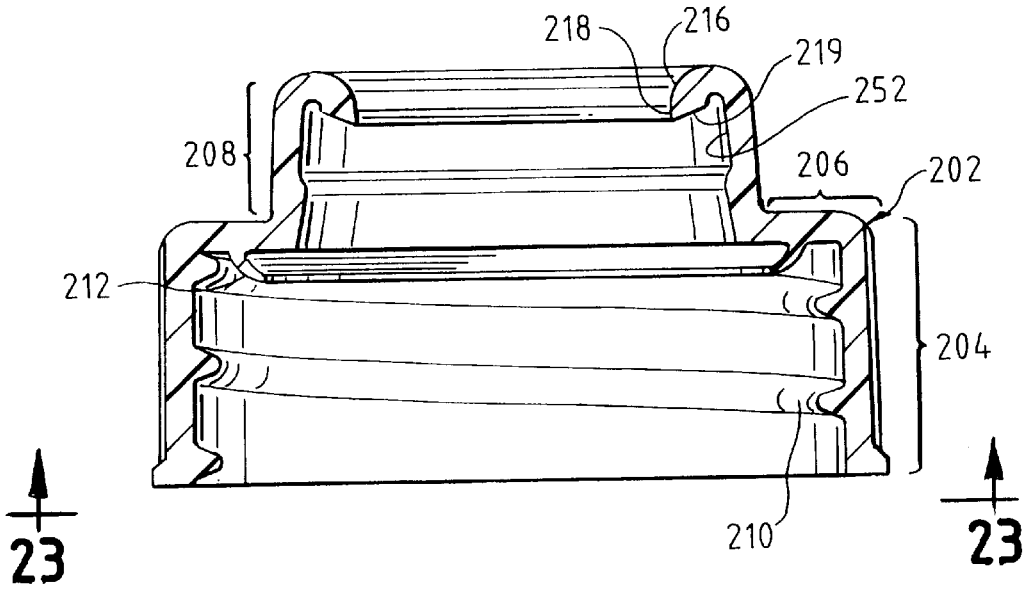
FIG. 22 is a cross-sectional view taken generally along the plane 22—22 in FIG. 21.
Figure 23:
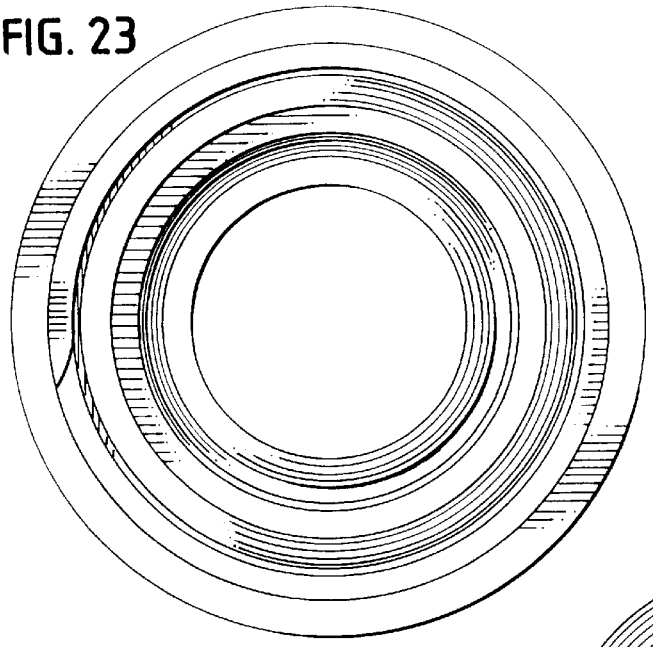
FIG. 23 is a bottom plan view taken generally along the plane 23—23 in FIG. 22.
Figure 24:
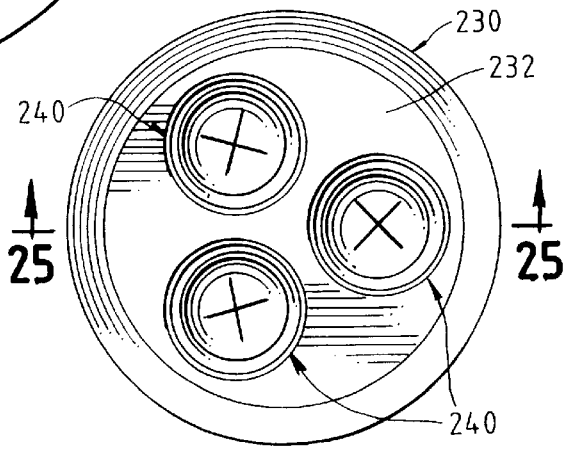
FIG. 24 is a top plan view of the valve pad or valve array structure of the second embodiment shown in FIG. 16.

As can be seen in FIG. 22, the closure 200 has a body or housing 202 which includes a base or skirt 204, an annular shoulder 206 extending radially inwardly from the top of the skirt 204, and a reduced diameter spout 208 extending upwardly from the inner portion of the shoulder 206.

As can be seen in FIG. 22, the interior of the skirt 204 defines a thread 210. The skirt 204 is adapted to receive the upper end of a container mouth or neck (not illustrated). The skirt thread 210 is adapted to matingly engage a thread on the container mouth or neck.

Alternatively, the closure having skirt 204 could be provided with some other container connecting means, such as a snap-fit bead (not illustrated) in place of the thread 210 for engaging a mating groove (not illustrated) in the container neck. The closure body or housing 202 could also be permanently fixed to the container by means of induction melting, ultrasonic melting, gluing, or the like, depending on the materials used for the closure body or housing 202 and the container. The closure housing 202 could also be formed as a unitary part, or extension, of the container.

The closure housing skirt 204 may have any suitable configuration. The container could have an upwardly projecting neck or other portion for being received within the particular configuration of the closure housing, and the main part of the container may have a different cross-sectional shape than the container neck and closure housing skirt 204.

The closure 200 is adapted to be used with a container having a mouth or other opening to provide access to the container interior and to a product contained therein. The product may be, for example, a liquid comestible product. The product could also be any other liquid, solid, or gaseous material, including, but not limited to, a powder, a food product, a personal care product, an industrial or household cleaning product, or other chemical compositions (e.g., compositions for use in activities involving manufacturing, commercial or household maintenance, construction, agriculture, etc.).

The container would typically be a squeezable container having a flexible wall or walls which can be grasped by the user and squeezed or compressed to increase the internal pressure within the container so as to force the product out of the container and through the closure 200. The container wall typically has sufficient, inherent resiliency so that when the squeezing forces are removed, the container wall returns to its normal, unstressed shape. Such a squeezable wall structure is preferred in many applications but may not be necessary or preferred in other applications. For example, in some applications it may be desirable to employ a generally rigid container and pressurize the container interior at selected times with a piston or other pressurizing system.

An annular, "crab's claw" seal 212 projects downwardly from the underside of the body shoulder 206 as can be seen in FIG. 22. The seal 212 is adapted to sealingly engage the inside, annular edge of the container (not illustrated) on which the closure 200 is mounted.

Figure 19:
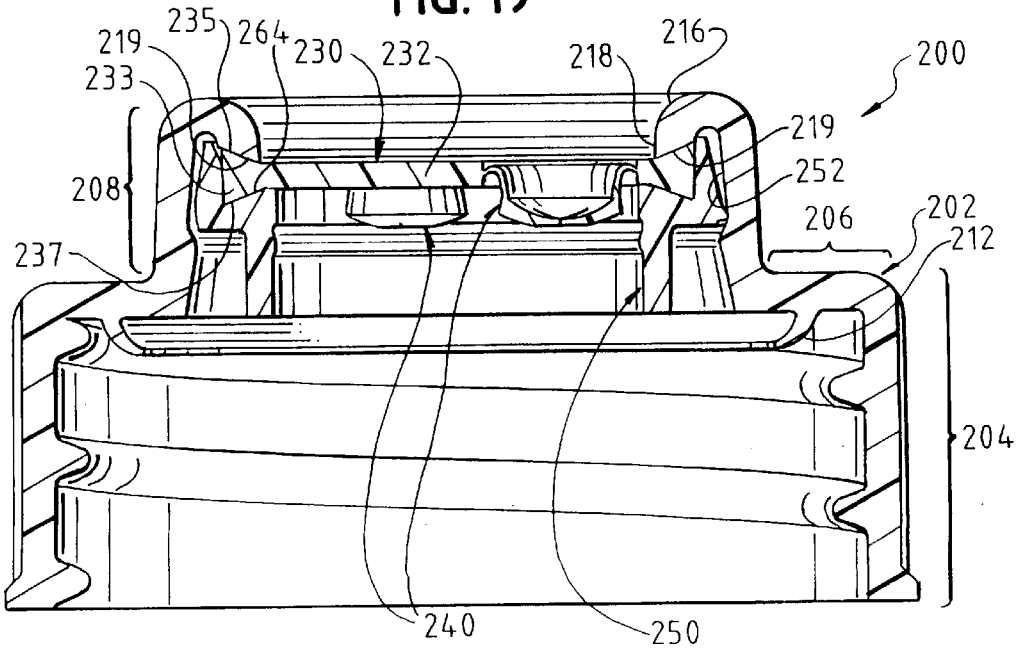
FIG. 19 is a cross-sectional view taken generally along the plane 19—19 in FIG. 18.
Figure 20:
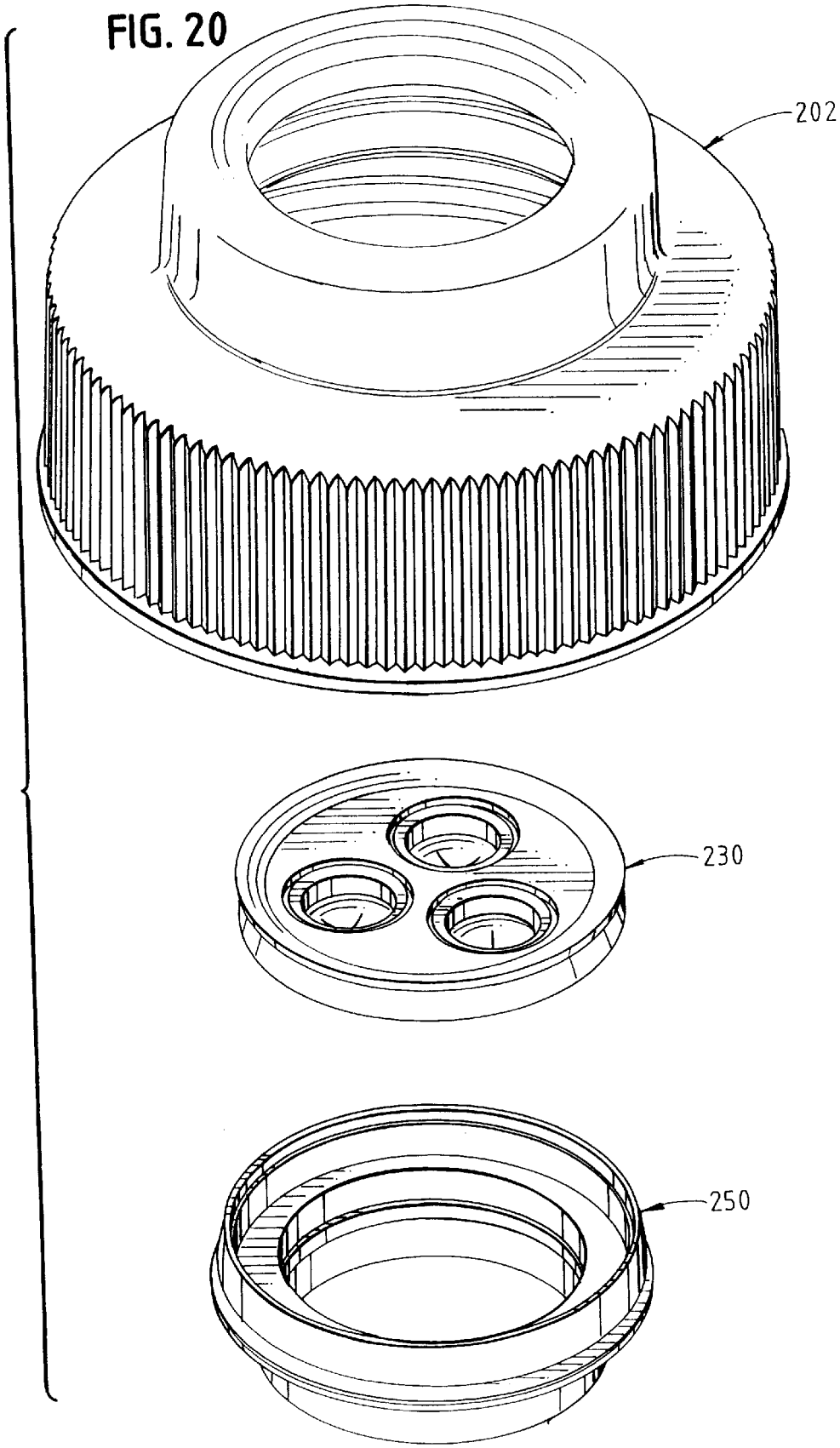
FIG. 20 is an exploded, perspective view of the second embodiment of the closure.
Figure 21:
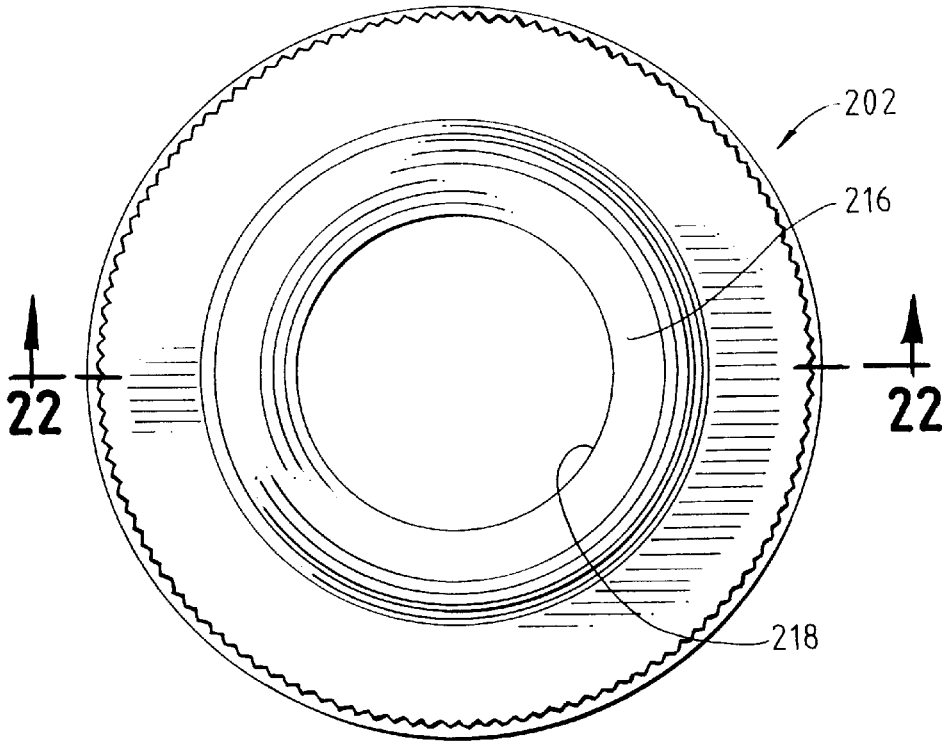
FIG. 21 is a top plan view of the closure housing of the second embodiment shown in FIG. 16.

The closure body or housing 202 includes an annular shoulder 216 defining a single, circular, central opening 218 and an annular, frustoconical clamping surface 219 as can be seen in FIGS. 19 and 22.

The dispensing closure body or housing 202 is preferably molded from a thermoplastic material such as polypropylene to form a generally rigid, hard, plastic structure. The particular material from which the housing or body 202 is made forms no part of the present invention.

With reference to FIGS. 19 and 24–26, the dispensing closure further includes a valve array structure 230. The valve array structure 230 is a unitary, resiliently flexible, molded structure which is preferably molded from a thermosetting elastomeric material, such as silicone rubber, natural rubber, and the like. The valve array structure 230 could also be molded from a thermoplastic elastomer. Preferably, the valve array structure 230 is molded from silicone rubber, such as the silicone rubber sold by The Dow Chemical Company in the United States of America under the trade designation DC-595.

The valve array structure 230 includes an impervious membrane 232 in which are located a plurality of resiliently flexible, slit valves 240 which are each molded unitary with the membrane 232. In the preferred, second embodiment illustrated in FIGS. 16–29, there are three valves 240 located in a generally planar array to dispense product from the container along generally parallel discharge paths. In the embodiment illustrated in FIGS. 16–29, the valves 240 all have an identical configuration and size. Each valve 240 is a resiliently flexible, slit valve which can have the same configuration, and operate in the same manner, as the first embodiment of the valve 140 described above with reference to FIGS. 8–12.

Figure 25:
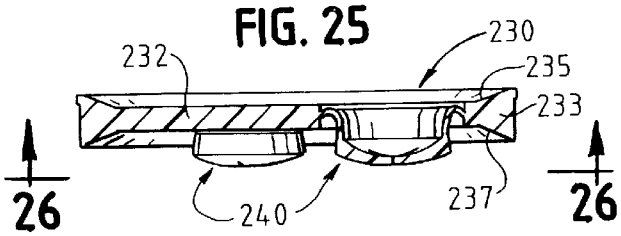
FIG. 25 is a cross-sectional view taken generally along plane 25—25 of FIG. 24.
Figure 26:
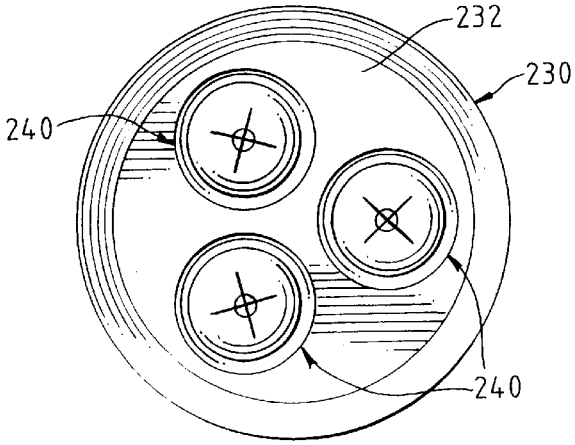
FIG. 26 is a bottom plan view taken generally along the plane 26—26 in FIG. 25.
Figure 27:
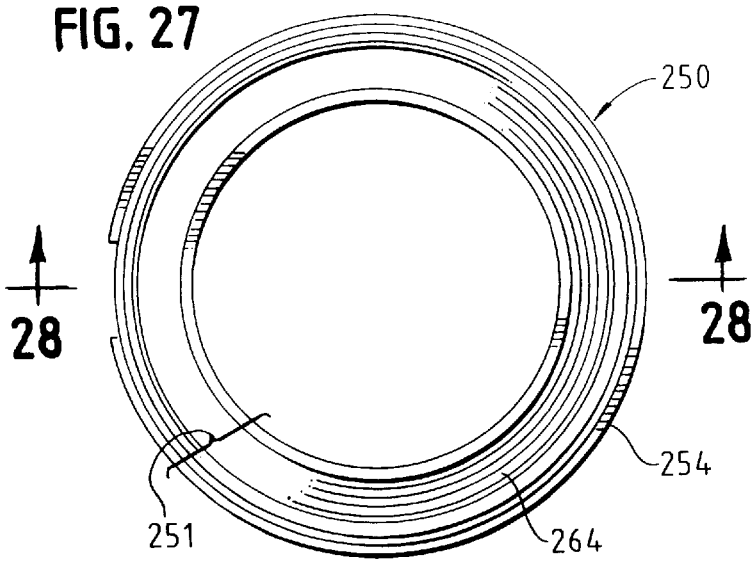
FIG. 27 is a top plan view of the retainer of the second embodiment shown in FIG. 16.
Figure 28:
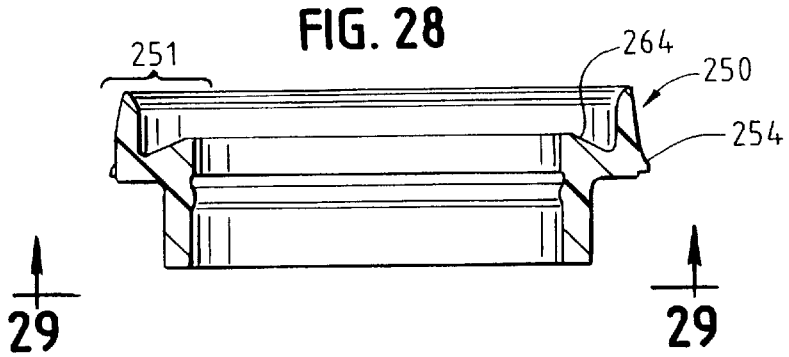
FIG. 28 is a cross-sectional view taken generally along the plane 28—28 in FIG. 27.
Figure 29:
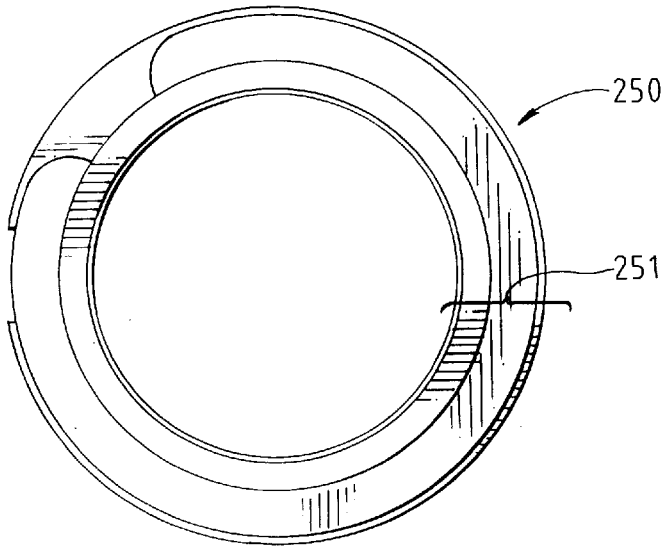
FIG. 29 is a bottom plan view taken generally along the plane 29—29 in FIG. 28.
Figure 30:
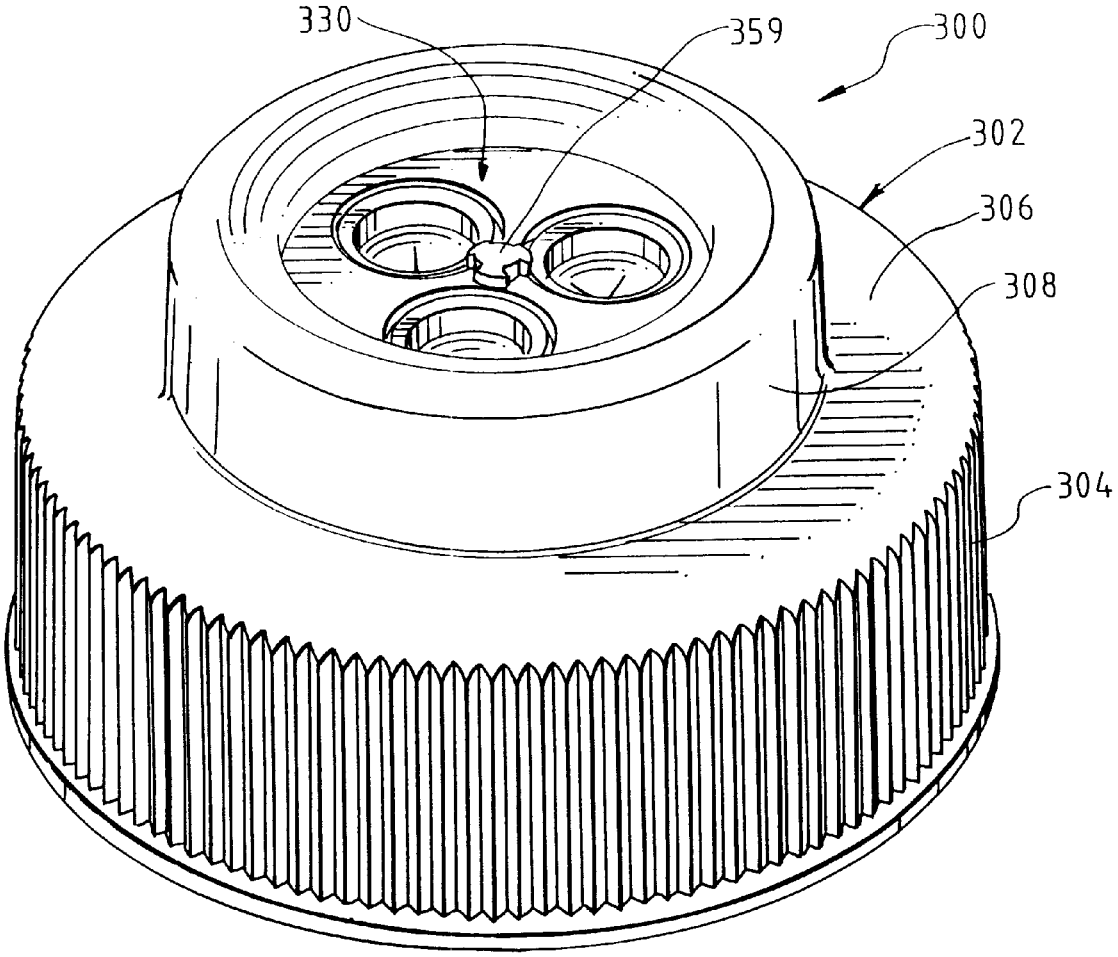
FIG. 30 is a perspective view of a third embodiment of the dispensing system of the present invention incorporated in a closure which is formed separately from, and which is adaptable to be releasably mounted to, a container which has an opening to the container interior.
Figure 31:
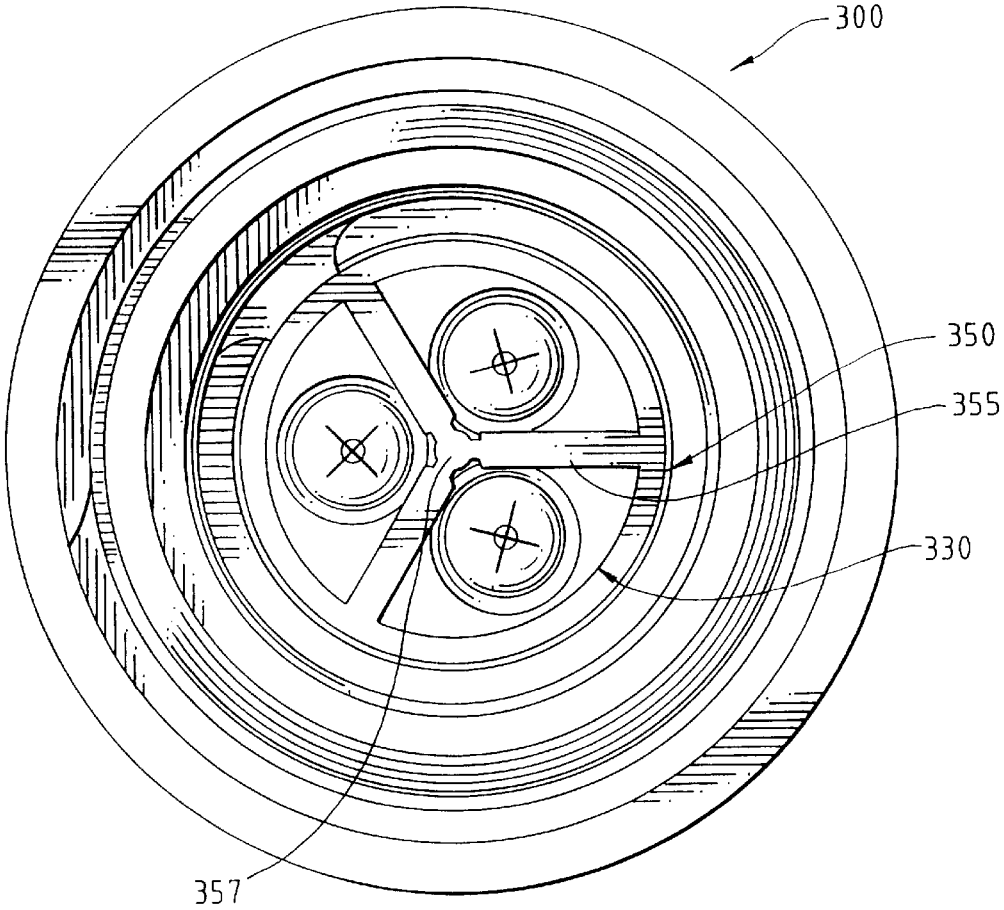
FIG. 31 is a bottom plan view of the third embodiment of the closure shown in FIG. 30.
Figure 32:
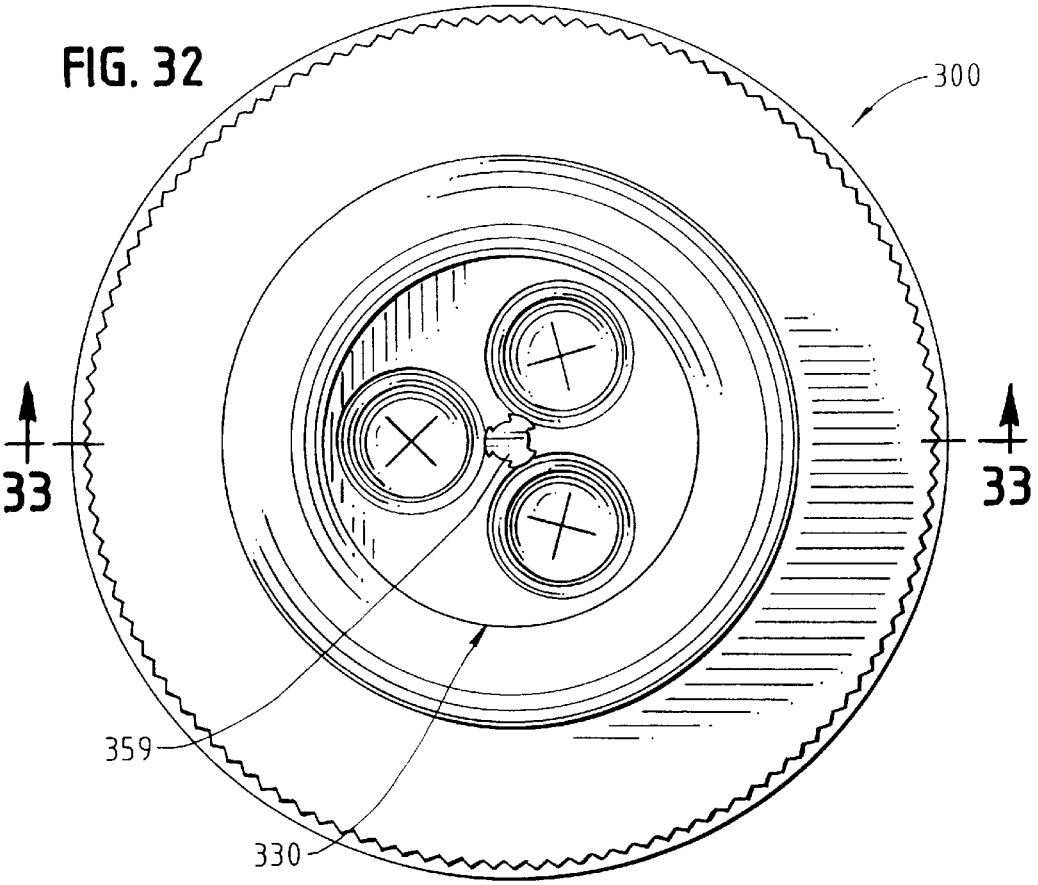
FIG. 32 is a top plan view of the third embodiment of the closure shown in FIG. 30.

In the second embodiment illustrated in FIG. 25, the three valves 240 are arranged equidistantly from one another, and the membrane 232 includes a peripheral, annular flange 233 which (1) lies radially beyond, and circumscribes, the valves 240 to define a generally circular, outer edge, and (2) has a dovetail cross section defining an upper or outer surface 235 and lower or inner surface 237.

The valve array structure 230 is retained within the housing 202 by means of a retainer 250 engaged with the housing 202 (FIGS. 19 and 27–29). The housing 202 defines an annular channel 252 (FIG. 22), and as shown in FIG. 19, a portion of the retainer 250 is received within the channel 252. To this end, the retainer 250 includes an annular wall 251 (FIGS. 27–29) having a peripheral portion 254 (FIG. 28) which is adapted to be received in the housing channel 252 in a snap-fit engagement.

The retainer annular wall 251 includes an annular, frustoconical seating surface 264 for supporting the periphery of the valve array structure 230. The seating surface 264 engages the lower surface 237 of the valve array structure flange 233 to force the upper surface 235 of the valve array structure flange 233 tight against the housing clamping surface 219.

In a presently preferred form, the retainer 250 is molded from a thermoplastic material such as polypropylene. The retainer 250 and/or the housing 202 are sufficiently deflectable to accommodate insertion of the retainer 250 into the housing 202 so as to effect the snap-fit engagement of the retainer peripheral portion 254 in the housing annular channel 252.

When the three valves 240 are each located in a generally planar array as illustrated for the second embodiment in FIGS. 16–29, the product is discharged through each of the valves 240 substantially as three parallel continuous or discontinuous streams. In other contemplated embodiments, the valve array structure 230 could be generally non-planar, such as convex or concave as viewed from the exterior of the package. A concave configuration would result in the multiple streams being generally focused inwardly toward a reduced diameter target area at some distance from the end of the package. A convex configuration would result in a outwardly flaring, or conical, spray pattern.

If desired, the second embodiment closure housing 202 may be optionally provided with an attached, or completely removable, lid (not illustrated) as described above for the first embodiment of the dispensing system 100 illustrated in FIGS. 1–15. The lid may be hinged with a conventional or special snap-action hinge, or the lid may simply be tethered to the housing. The lid may also include inwardly extending plugs or members for being received in the concave region of each valve 240 as a means for preventing the valves 240 from opening during shipping and handling when the packages could be subjected to exterior forces that could cause internal, transient pressure increases that might otherwise open the valves.

The optional, releasable liner or removable label described above for the first embodiment may also be initially attached across the top of the second embodiment housing 202 to the exterior surface of the housing shoulder 216. This would also prevent discharge of product from the valves 240 during shipping and handling when the packages are subjected to external impact forces or squeezing forces. Once such lids or removable liners have been removed by the user, they could be saved by the user and re-applied to the top of the closure when the user subsequently wants to stow the package in luggage while travelling. This would prevent the product from being discharged from the package if the package is subjected to external impact forces causing transient pressure increases in the package.

FIGS. 30–43 illustrate a third embodiment of the dispensing system of the present invention. The third embodiment is also in the form of a dispensing closure which is designated generally by the reference number 300 in FIGS. 30–43.

As can be seen in FIGS. 30 and 35–37, the closure 300 has a body or housing 302 which is identical with the second embodiment housing 202 described above with reference to FIGS. 16–29. The housing 302 includes a base or skirt 304, an annular shoulder 306 extending radially inwardly from the top of the skirt 304, and a reduced diameter spout 308 extending upwardly from the inner portion of the shoulder 306.

Figure 33:
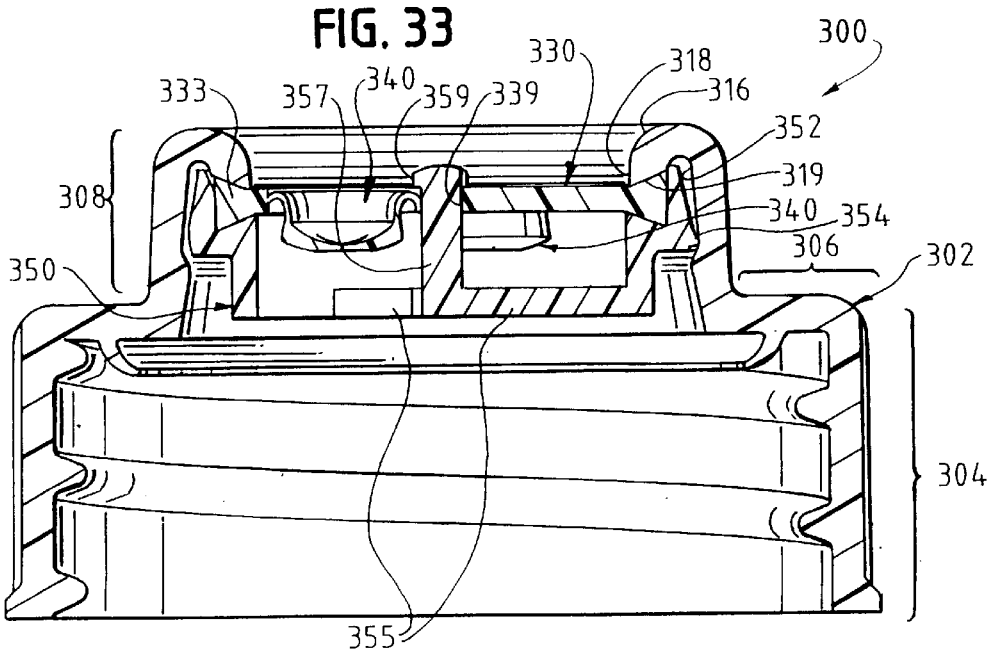
FIG. 33 is a cross-sectional view taken generally along the plane 33—33 in FIG. 32.
Figure 34:
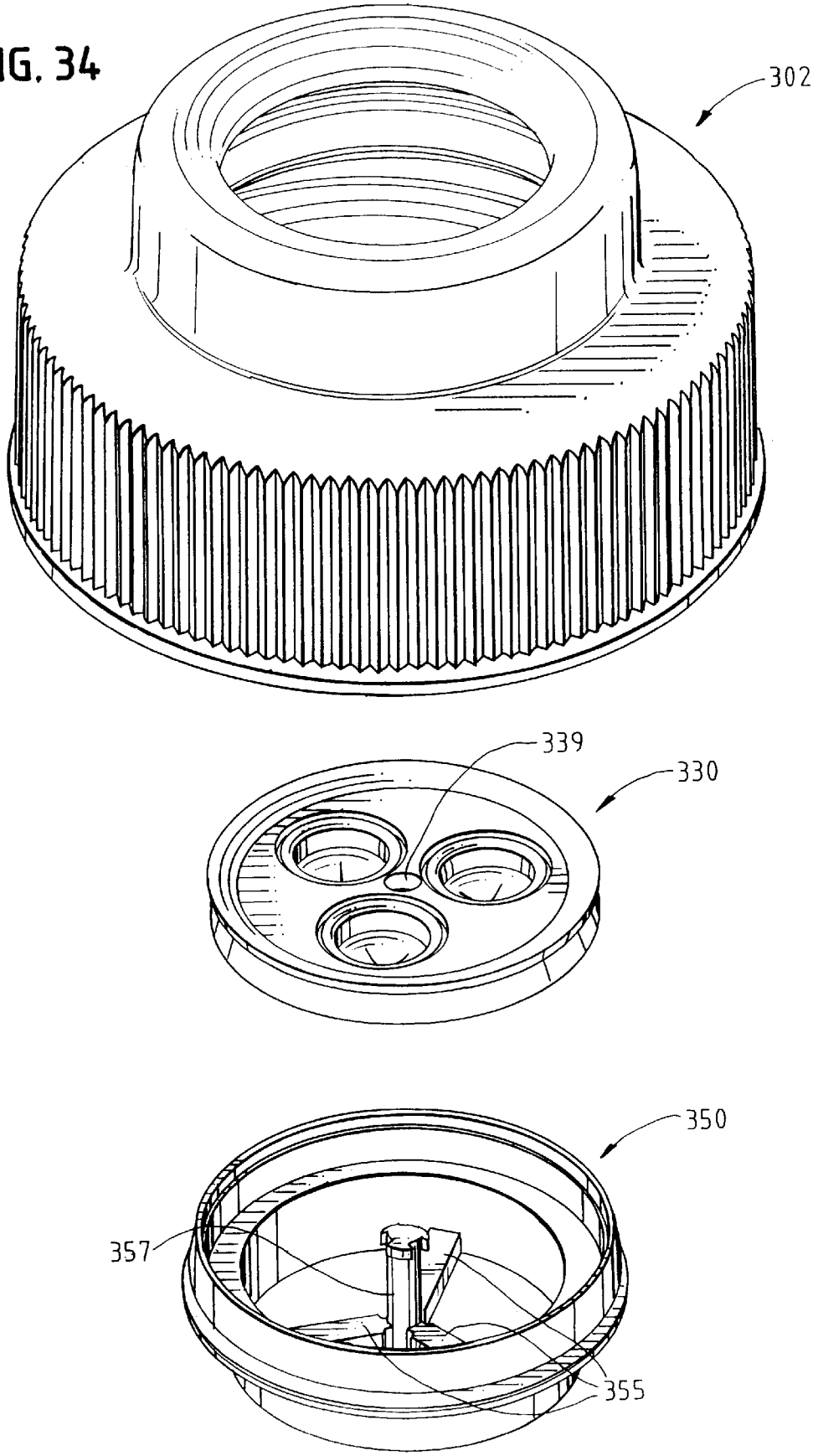
FIG. 34 is an exploded, perspective view of the third embodiment of the closure shown in FIG. 30.
Figure 35:
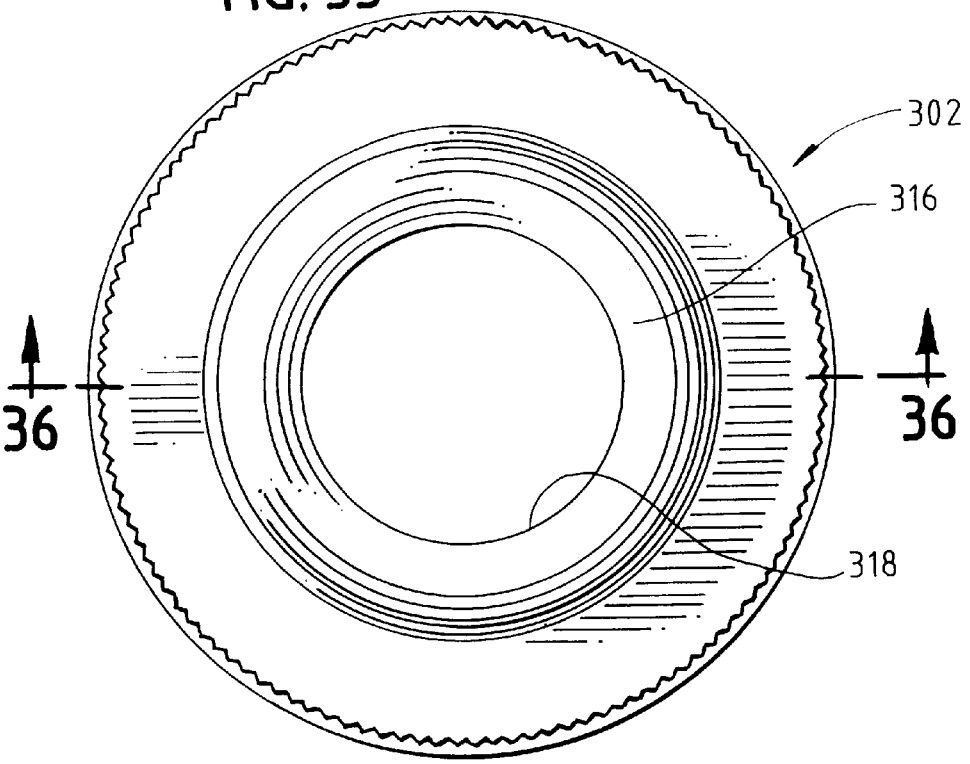
FIG. 35 is a top plan view of the closure housing of the third embodiment shown in FIG. 30.
Figure 36:
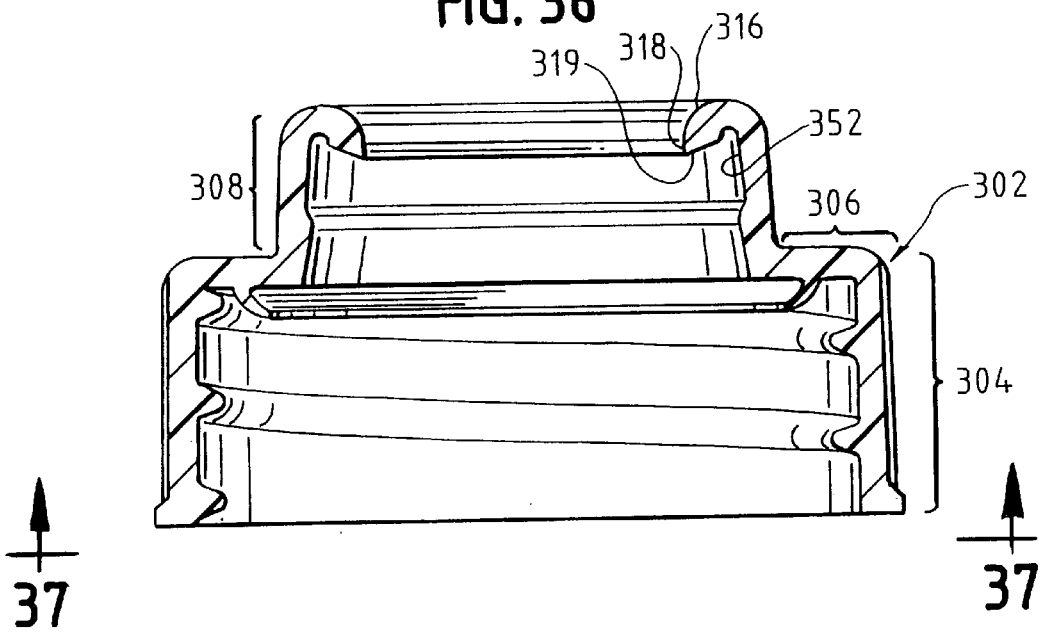
FIG. 36 is a cross-sectional view taken generally along the lane 37—37 in FIG. 35.
Figure 37:
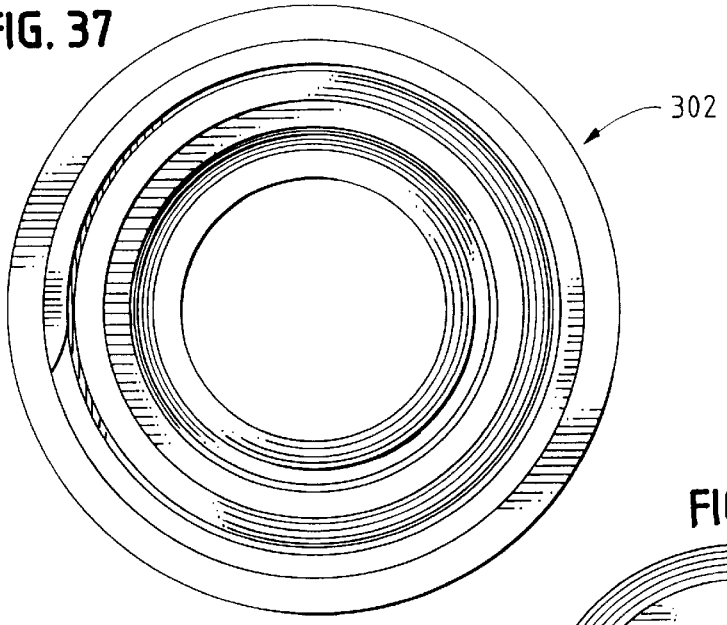
FIG. 37 is a bottom plan view taken generally along the plane 37—37 in FIG. 36.
Figure 38:
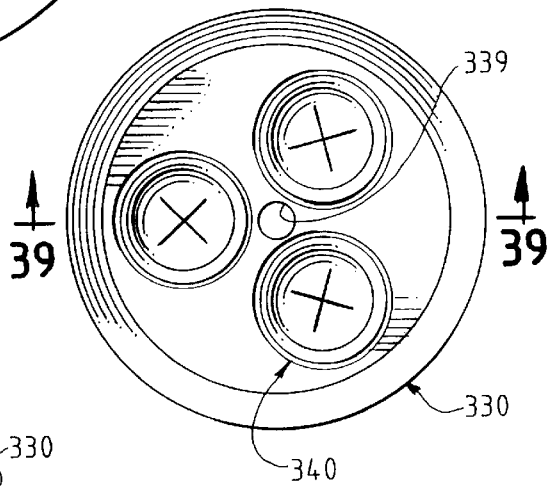
FIG. 38 is a top plan view of the valve pad or valve array structure of the third embodiment shown in FIG. 30.
Figure 39:
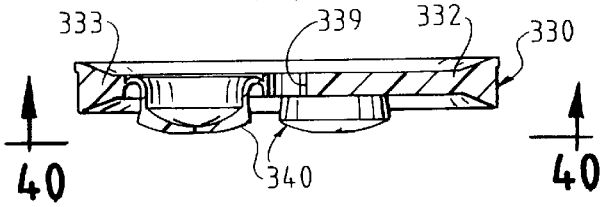
FIG. 39 is a cross-sectional view taken generally along the plane 39—39 in FIG. 38.
Figure 40:
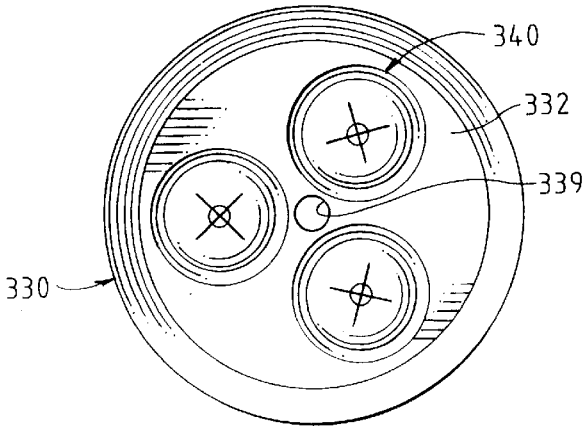
FIG. 40 is a bottom plan view taken generally along the plane 40—40 in FIG. 39.
Figure 41:
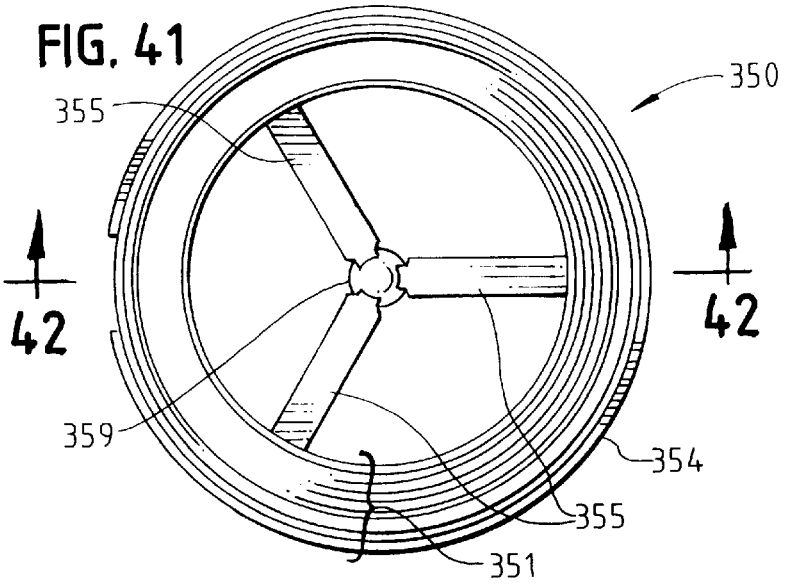
FIG. 41 is a top plan view of the retainer of the third embodiment shown in FIG. 30.
Figure 42:
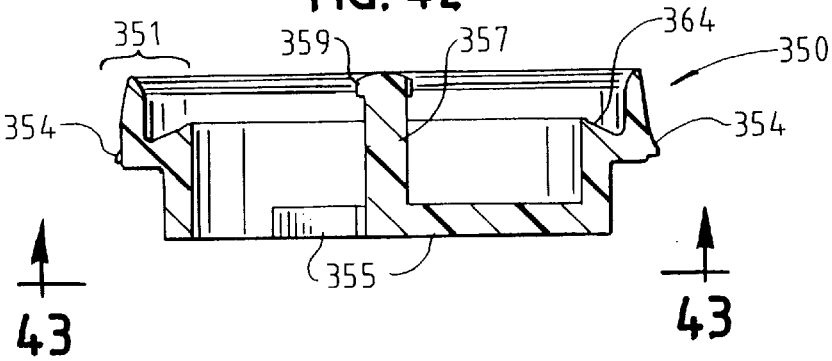
FIG. 42 is a cross-sectional view taken generally along the plane 42—42 in FIG. 41.
Figure 43:
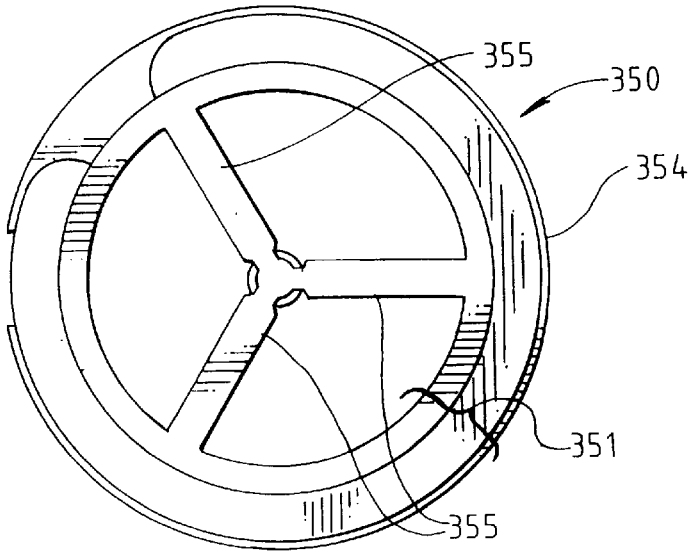
FIG. 43 is a bottom plan view taken generally along the plane 43—43 in FIG. 42.

The closure body or housing 302 includes an annular shoulder 316 defining a single, circular, central opening 318 and an annular, frustoconical clamping surface 319 as can be seen in FIGS. 33 and 36.

With reference to FIGS. 33 and 38–40, the dispensing closure 300 further includes a valve array structure 330. The valve array structure 330 is a unitary, resiliently flexible, molded structure which is substantially identical with the second embodiment valve array structure 230 described above with reference to FIGS. 16–29 except that the third embodiment valve array structure 330 includes a central aperture 339 in an impervious membrane 332 between a plurality of resiliently flexible, slit valves 340 which are each molded unitary with the membrane 332 and have the same configuration as the second embodiment valves 240.

The valve array structure 330 has a flange 333 and is retained within the housing 302 by means of a retainer 350 engaged with the housing 302 (FIGS. 33 and 41–43). The housing 302 defines an annular channel 352 (FIG. 36), and as shown in FIG. 33, a portion of the retainer 350 is received within the channel 352. To this end, the retainer 350 includes an annular wall 351 (FIGS. 41–43) having a peripheral portion 354 (FIG. 28) which is adapted to be received in the housing channel 352 in a snap-fit engagement.

The retainer annular wall 351 includes an annular, frustoconical seating surface 364 (FIG. 42) for supporting the periphery of the valve array structure 330. The seating surface 364 engages the lower surface of the valve array structure flange 333 (FIG. 33) to force the upper surface of the valve array structure flange 333 tight against the housing clamping surface 319.

In a presently preferred form, the retainer 350 is molded from a thermoplastic material such as polypropylene. The retainer 350 and/or the housing 302 are sufficiently deflectable to accommodate insertion of the retainer 350 into the housing 302 so as to effect the snap-fit engagement of the retainer peripheral portion 354 in the housing annular channel 352.

The retainer 350 includes at least one, and preferably three, support arms 355 extending radially inwardly from the annular wall 351 to a central post 357. The distal end of the central post 357 is adapted to be received in the valve array structure central aperture 339 as shown in FIG. 33. The post 357 engages the valve array structure 330 to stiffen and stabilize the central portion of the valve array structure 330. The top end of the post 357 has an enlarged head 359 which projects radially over the upper edge of the central aperture 339 on the exterior side of the valve array structure 330 as shown in FIG. 33.

When the three valves 340 are each located in a generally planar array as illustrated for the third embodiment in FIGS. 30–43, the product is discharged through each of the valves 340 substantially as three parallel continuous or discontinuous streams. As with the second embodiment previously described, the valve array structure 330 could instead be generally non-planar, such as convex or concave as viewed from the exterior of the package.

Also, the third embodiment closure housing 302 may be optionally provided with an attached, or completely removable, lid (not illustrated) as described above for the first embodiment of the dispensing system 100 illustrated in FIGS. 1–15.

An optional, releasable liner or removable label, such as described above for the first embodiment, may also be initially attached across the top of the third embodiment housing 302 to the exterior surface of the housing shoulder 316.

FIGS. 44–54 illustrate a fourth embodiment of the dispensing system of the present invention. The fourth embodiment is also in the form of a dispensing closure which is designated generally by the reference number 400 in FIGS. 44–54.

Figure 44:
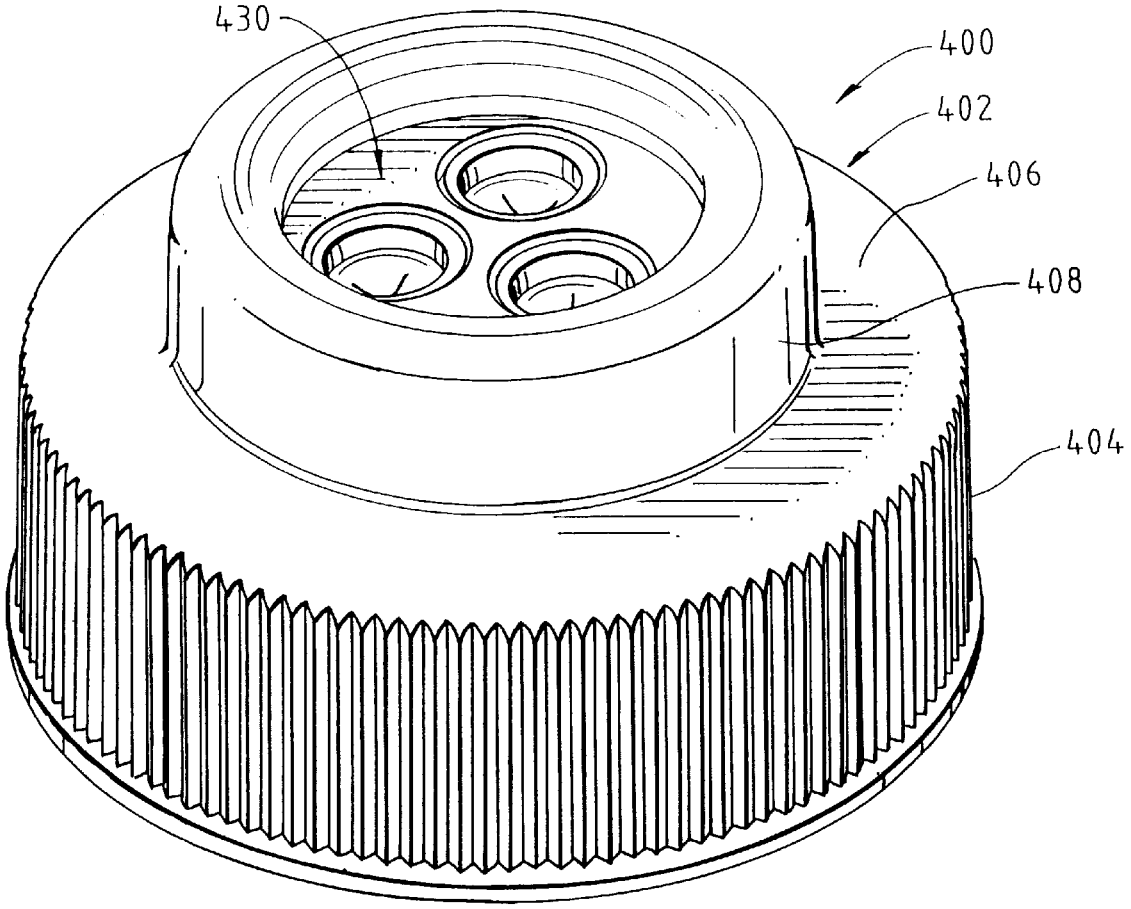
FIG. 44 is a perspective view of a fourth embodiment of the dispensing system of the present invention incorporated in a dispensing closure which is formed separately from, and which is adaptable to be releasably mounted to, a container which has an opening to the container interior.
Figure 45:
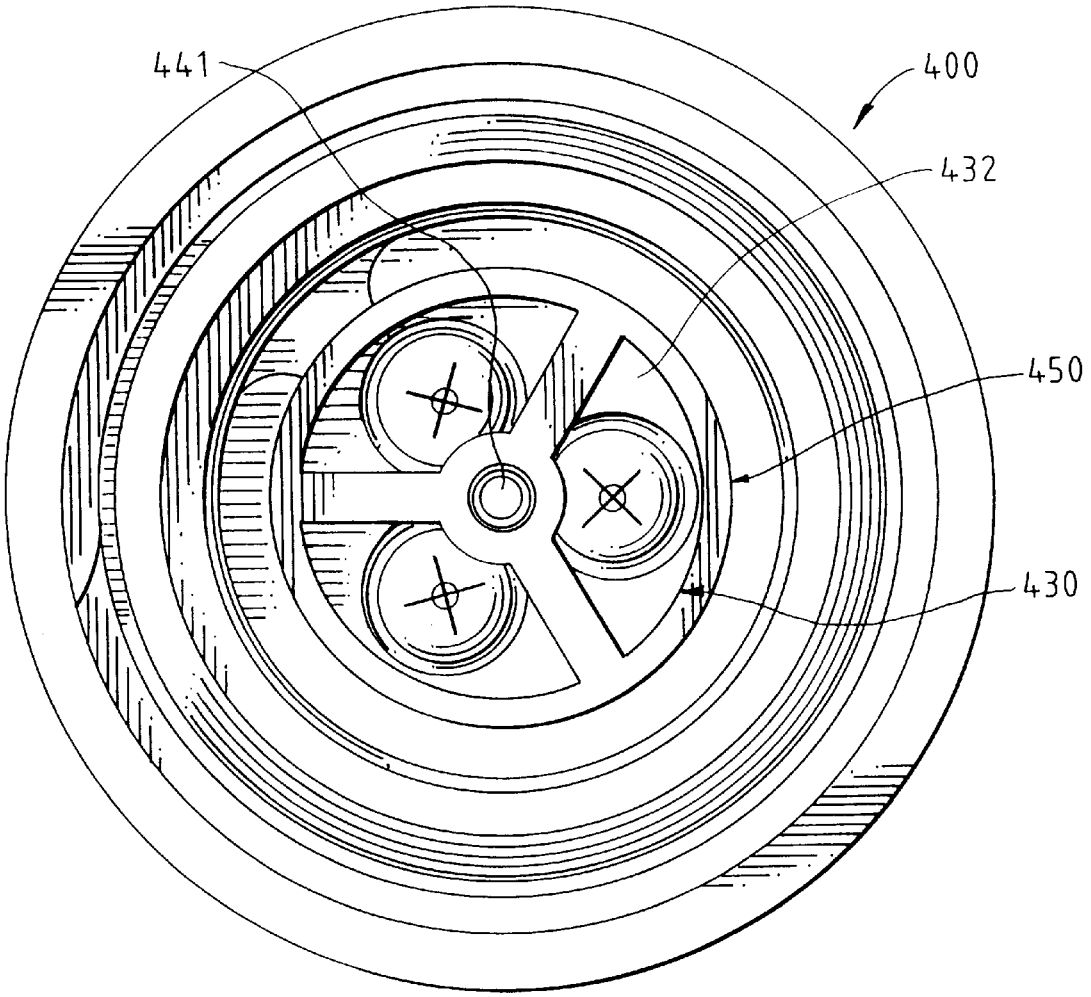
FIG. 45 is a bottom plan view of the fourth embodiment of the closure shown in FIG. 44.
Figure 46:
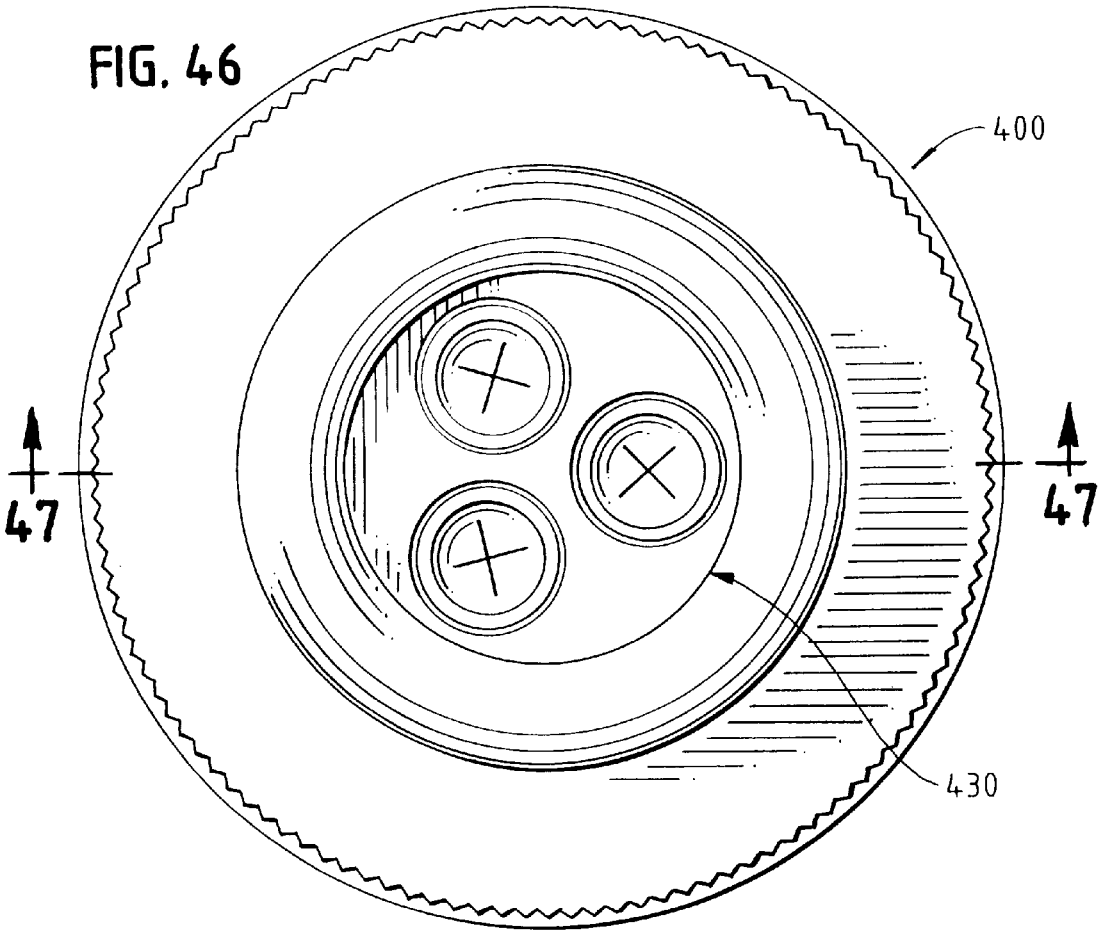
FIG. 46 is a top plan view of the fourth embodiment of the closure shown in FIG. 44.
Figure 47:
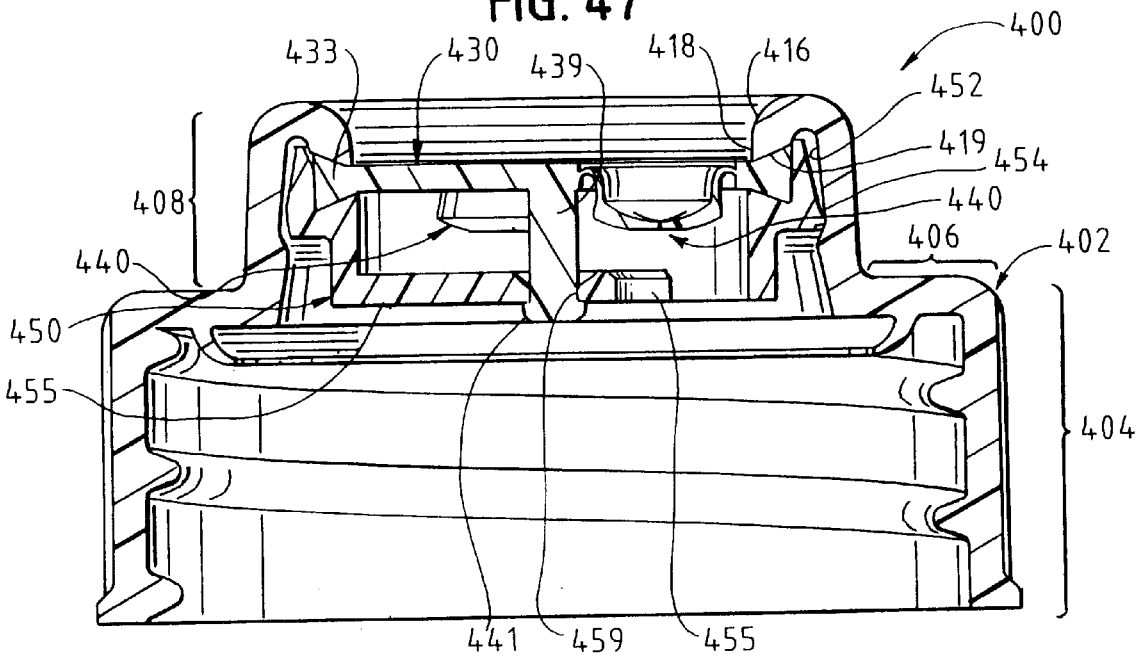
FIG. 47 is a cross-sectional view taken generally along the plane 47—47 in FIG. 46.
Figure 48:
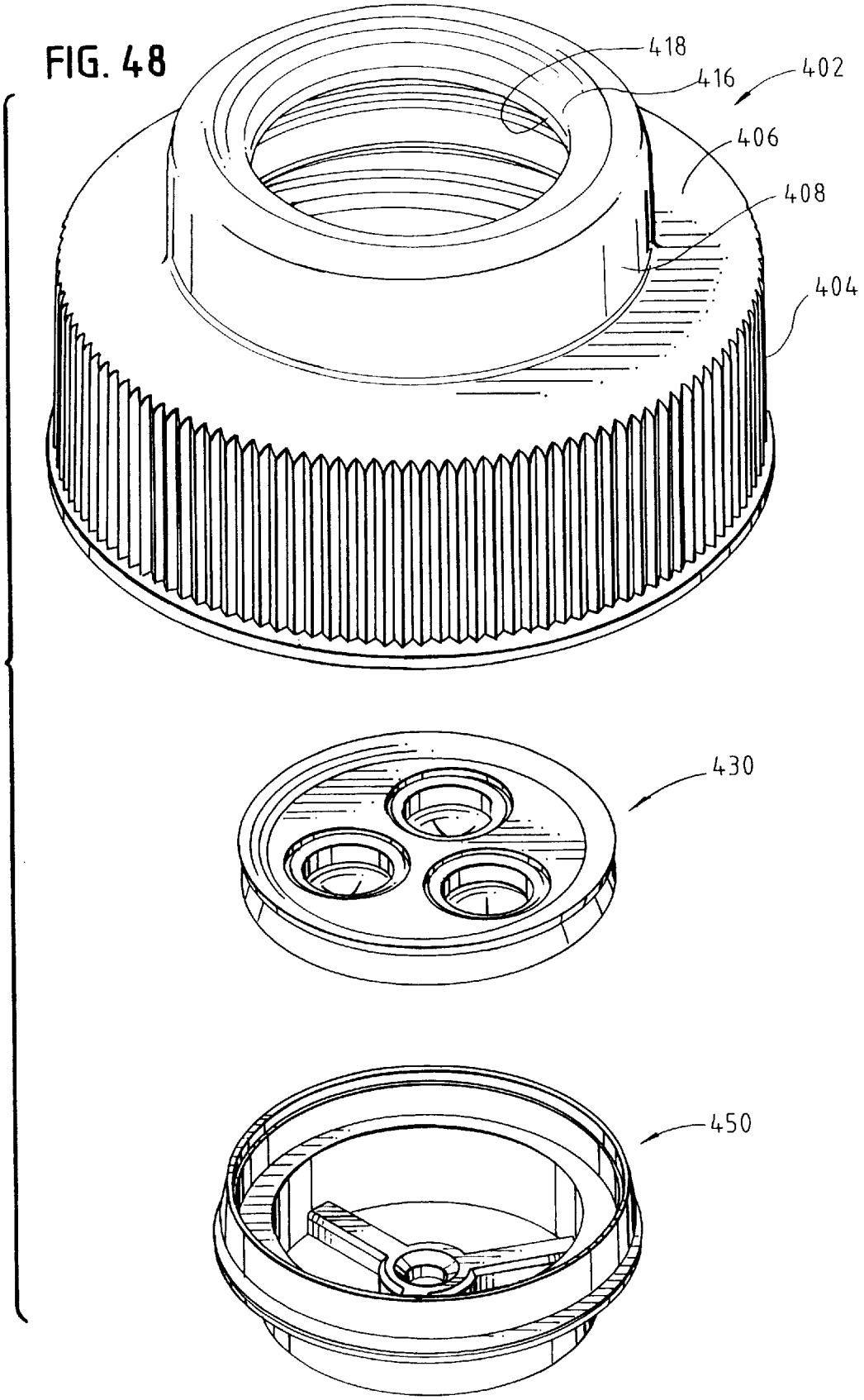
FIG. 48 is an exploded, perspective view of the fourth embodiment of the closure shown in FIG. 44.
Figure 49:
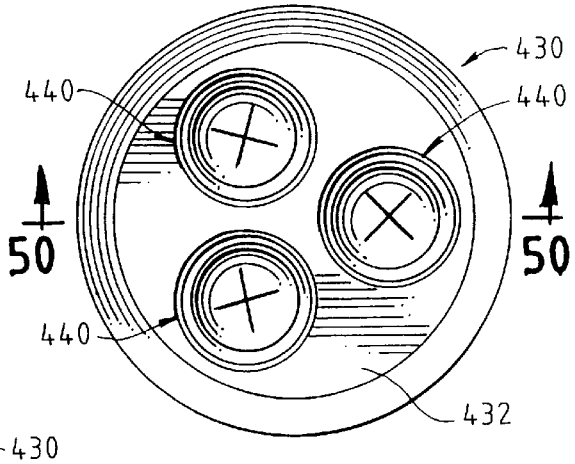
FIG. 49 is a top plan view of the valve pad or valve array structure of the fourth embodiment shown in FIG. 44.
Figure 50:
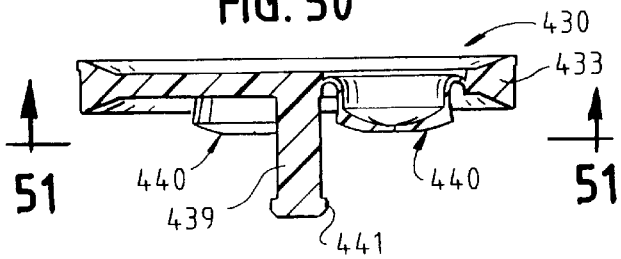
FIG. 50 is a cross-sectional view taken generally along the plane 50—50 in FIG. 49.
Figure 51:
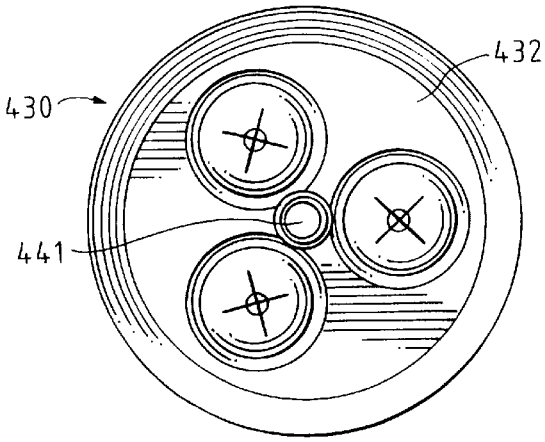
FIG. 51 is a bottom plan view taken generally along the plane 51—51 in FIG. 50.
Figure 52:
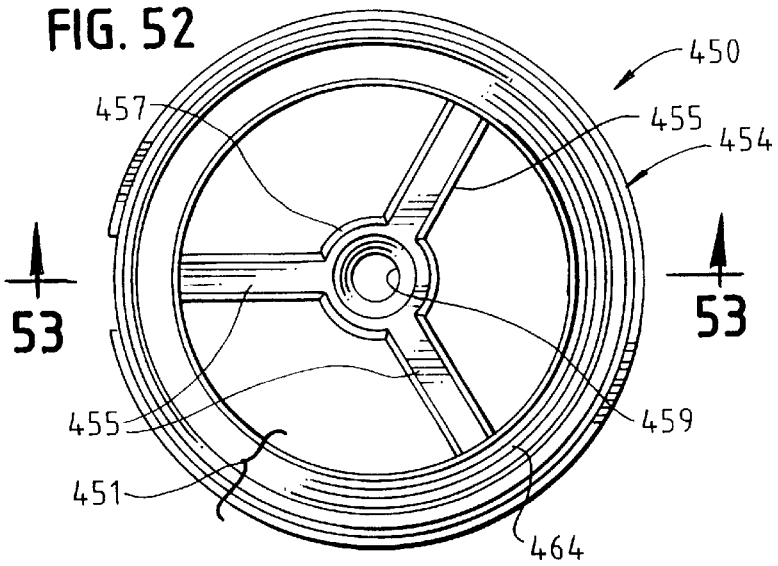
FIG. 52 is a top plan view of the retainer of the fourth embodiment shown in FIG. 44.
Figure 53:
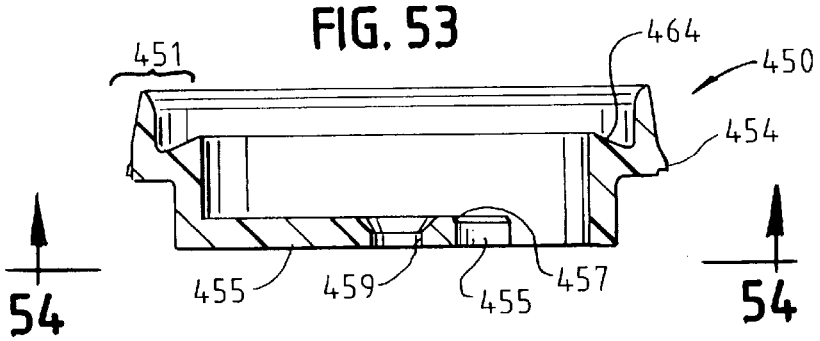
FIG. 53 is a cross-sectional view taken generally along the plane 53—53 in FIG. 52.
Figure 54:
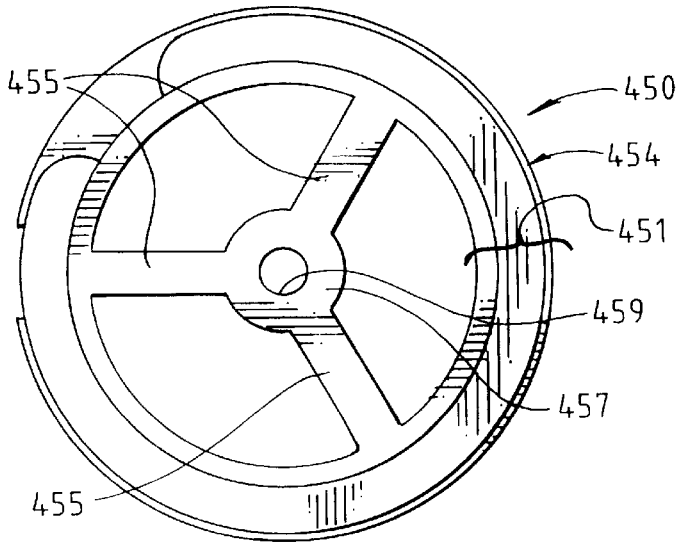
FIG. 54 is a bottom plan view taken generally along the plane 54—54 in FIG. 53.

As can be seen in FIGS. 44, 47, and 48, the closure 400 has a body or housing 402 which is identical with the second embodiment housing 202 described above with reference to FIGS. 16–29. The housing 402 includes a base or skirt 404, an annular shoulder 406 extending radially inwardly from the top of the skirt 404, and a reduced diameter spout 408 extending upwardly from the inner portion of the shoulder 406.

The closure body or housing 402 includes an annular shoulder 416 (FIG. 48) defining a single, circular, central opening 418 and an annular, frustoconical clamping surface 419 as can be seen in FIGS. 47 and 48.

With reference to FIGS. 47 and 49–51, the dispensing closure 400 further includes a valve array structure 430. The valve array structure 430 is a unitary, resiliently flexible, molded structure which is substantially identical with the second embodiment valve array structure 230 described above with reference to FIGS. 16–29 except that the fourth embodiment valve array structure 430 includes a central post 439 (FIG. 50) which projects downwardly from an impervious membrane 432 between a plurality of resiliently flexible, slit valves 440 which are each molded unitary with the membrane 432 and which each has the same configuration as the second embodiment valves 240. The post 439 has an enlarged head 441.

The valve array structure 430 has a flange 433 and is retained within the housing 402 by means of a retainer 450 (FIGS. 47 and 52–54) engaged with the housing 402 (FIG. 47). The housing 402 defines an annular channel 452 (FIG. 47), and as shown in FIG. 47, a portion of the retainer 450 is received within the channel 452. To this end, the retainer 450 includes an annular wall 451 (FIGS. 52–54) having a peripheral portion 454 (FIG. 53) which is adapted to be received in the housing channel 452 in a snap-fit engagement (FIG. 47).

The retainer annular wall 451 includes an annular, frustoconical seating surface 464 (FIG. 53) for supporting the periphery of the valve array structure 430 as shown in FIG. 47. The seating surface 464 engages the lower surface of the valve array structure flange 433 (FIG. 47) to force the upper surface of the valve array structure flange 433 tight against the housing clamping surface 419.

In a presently preferred form, the retainer 450 is molded from a thermoplastic material such as polypropylene. The retainer 450 and/or the housing 402 are sufficiently deflectable to accommodate insertion of the retainer 450 into the housing 402 so as to effect the snap-fit engagement of the retainer peripheral portion 454 in the housing annular channel 452.

The retainer 450 includes at least one, and preferably three, support arms 455 extending radially inwardly from the bottom of the annular wall 451 to a central ring 457 which defines a circular aperture 459. The aperture 459 is adapted to receive the valve array structure central post 439 as shown in FIG. 47. The post 439 engages the retainer ring 457 to stiffen and stabilize the central portion of the valve array structure 430. The enlarged head 441 on the bottom end of the post 439 projects radially over the lower edge of the ring aperture 459 on the interior side of the retainer 450 as shown in FIG. 47.

When the three valves 440 are each located in a generally planar array as illustrated for the fourth embodiment in FIGS. 44–54, the product is discharged through each of the valves 440 substantially as three parallel continuous or discontinuous streams. As with the second embodiment previously described, the valve array structure 430 could instead be generally non-planar, such as convex or concave as viewed from the exterior of the package.

Also, the third embodiment closure housing 402 may be optionally provided with an attached, or completely removable, lid (not illustrated) as described above for the first embodiment of the dispensing system 100 illustrated in FIGS. 1–15.

An optional, releasable liner or removable label, such as described above for the first embodiment, may also be initially attached across the top of the fourth embodiment housing 402 to the exterior surface of the housing shoulder 416.

It will be readily apparent from the foregoing detailed description of the invention and from the illustrations thereof that numerous variations and modifications may be effected without departing from the true spirit and scope of the novel concepts or principles of this invention.

What is claimed is:

1. A dispensing system for dispensing a product from a container having an opening, said system comprising:

a unitary, resiliently flexible, molded valve array structure for being sealingly disposed on said container over said opening, said valve array structure including (1) an impervious membrane having a generally planar region; and (2) a plurality of resiliently flexible, slit valves molded unitary with said membrane, each said valve having a normally closed dispensing orifice which opens when the pressure in the interior of said container exceeds the pressure on the exterior of the valve by a predetermined amount, each said valve includes (1) a valve head portion central wall defining a concave configuration as viewed from the exterior, and (2) a flexible skirt extending from said valve head portion central wall toward said generally planar region of said membrane.

2. The dispensing system in accordance with claim 1 in which said valve array structure is molded from a thermosetting elastomer.

3. The dispensing system in accordance with claim 1 in which said valve array structure has a circular outer edge.

4. The dispensing system in accordance with claim 3 in which said valve array structure includes an annular region of said membrane which lies radially beyond, and circumscribes, said valves.

5. The dispensing system in accordance with claim 1 in which said valve array structure includes three of said valves arranged equidistantly from one another.

6. The dispensing system in accordance with claim 1 in which said valves are located in a generally planar array to dispense product from said container along generally parallel discharge paths.

7. The dispensing system in accordance with claim 1 in which said valves all have the identical configuration and size.

8. The dispensing system accordance with claim 1 in which at least one of said valves is a self-closing valve which closes when the pressure on the exterior of the valve exceeds the pressure in the interior of said container by a predetermined amount.

9. The dispensing system in accordance with claim 1 in which said system is a dispensing closure that is separate from, but releasably attachable to, said container around said opening.

10. The dispensing system in accordance with claim 9 in which said dispensing system includes (1) a housing for mounting to said container, and (2) a retainer engaged with said housing to retain said valve array structure within said housing.

11. The dispensing system in accordance with claim 10 in which said closure housing includes an annular channel; and said retainer includes a peripheral portion adapted to be received in said channel in a snap-fit engagement.

12. A dispensing system for dispensing a product from a container having an opening, said system comprising:

a dispensing closure that is separate from, but releasably attachable to, said container around said opening; said closure containing a unitary, resiliently flexible, molded valve array structure for being sealingly disposed on said container over said opening; said valve array structure including (1) an impervious membrane, and (2) a plurality of resiliently flexible, slit valves molded unitary with said membrane, each said valve having a normally closed dispensing orifice which opens when the pressure in the interior of said container exceeds the pressure on the exterior of the valve by a predetermined amount; said closure including (1) a housing for mounting to said container, and (2) a retainer engaged with said housing to retain said valve array structure within said housing;

said housing including a central end wall defining a plurality of circular openings each aligned in registration with a different one of said valves;

said housing including at least one projection extending from said central end wall; and said valve array structure defining at least one aperture for receiving said at least one projection to establish a keyed relationship between said housing and said valve array structure to provide a predetermined orientation of said housing openings with said valves to define said aligned registration of said housing openings and valves.

13. The dispensing system in accordance with claim 12 in which said projection has a distal end that extends completely through, and beyond, said valve array structure; and said retainer defines at least one recess for receiving the distal end of said at least one projection to establish a keyed relationship between said retainer, said valve array structure, and said housing.

14. A dispensing system for dispensing a product having an opening, said system comprising:

a dispensing closure that is separate from, but releasably attachable to, said container around said opening; said closure containing a unitary, resiliently flexible, molded valve array structure for being sealingly disposed on said container over said opening; said valve array structure including (1) an impervious membrane, and (2) a plurality of resiliently flexible, slit valves molded unitary with said membrane, each said valve having a normally closed dispensing orifice which opens when the pressure in the interior of said container exceeds the pressure on the exterior of the valve by a predetermined amount; said closure containing (1) a housing for mounting to said container, and (2) a retainer engaged with said housing to retain said valve array structure within said housing;

said retainer including a support deck for supporting said membrane of said valve structure array;

said support deck defining a plurality of circular openings each aligned in registration with a different one of said valve; and each said valve including a portion received in, and extending beyond, one of said support deck openings.

15. A dispensing system for dispensing a product from a container having an opening, said system comprising:

a dispensing closure that is separate from, but releasably attachable to, said container around said opening; said closure containing a unitary, resiliently flexible, molded valve array structure for being sealingly disposed on said container over said opening; said valve array structure including (1) an impervious membrane, and (2) a plurality of resiliently flexible, slit valves molded unitary with said membrane, each said valve having a normally closed dispensing orifice which opens when the pressure in the interior of said container exceeds the pressure on the exterior of the valve by a predetermined amount; said closure including (1) a housing for mounting to said container, and (2) a retainer engaged with said housing to retain said valve array structure within said housing;

said valve array structure including an annular flange having a dovetail cross-section defining an outer surface and an inner surface;

said closure housing having a central opening surrounded by an annular, frustoconical clamping surface engaging said outer surface of said valve array structure flange; and said retainer having an annular, frustoconical clamping surface engaging said inner surface of said valve array structure flange.

16. A dispensing system for dispensing a product from a container having an opening, said system comprising:

a dispensing closure that is separate from, but releasably attachable to, said container around said opening; said closure containing a unitary, resiliently flexible, molded valve array structure for being sealing disposed on said container over said opening; said valve array structure including (1) an impervious membrane, and (2) a plurality of resiliently flexible, slit valves molded unitary with said membrane, each said valve having a normally closed dispensing orifice which opens when the pressure in the interior of said container exceeds the pressure on the exterior of the valve by a predetermined amount, said closure including (1) a housing for mounting to said container, and (2) a retainer engaged with said housing to retain said valve array structure within said housing;

said valve array structure including a central stiffening post having a distal end; and said retainer including (1) an annular wall, (2) a plurality of support arms extending radially inwardly from said annular wall, and (3) a central ring that is supported by said support arms and that receives said distal end of said stiffening post.

17. A dispensing system for dispensing a product from a container having an opening, said system comprising:

a dispensing closure that is separate from, but releasably attachable to, said container around said opening; said closure containing a unitary, resiliently flexible, molded valve array structure for being sealingly disposed on said container over said opening; said valve array structure including (1) an impervious membrane, and (2) a plurality of resiliently flexible, slit valves molded unitary with said membrane, each said valve having a normally closed dispensing orifice which opens when the pressure in the interior of said container exceeds the pressure on the exterior of the valve by a predetermined amount; said closure including (1) a housing for mounting to said container, and (2) a retainer engaged with said housing to retain said valve array structure within said housing;

said valve structure defining a central aperture; and said retainer including (1) an annular wall, (2) a plurality of support arms extending radially inwardly from said annular wall, and (3) a central post having a distal end extending from said support arms into said central aperture of said valve array structure to engage said valve array structure and stiffen said valve array structure.

18. The dispensing system in accordance with claim 17 in which said valve array structure has an exterior side adapted to face outwardly away from the interior of a container to which said dispensing closure can be attached; and said retainer includes an enlarged head at said distal end of said central post for being received on said exterior side of said valve array structure.

19. A dispensing system for dispensing a product from a container having an opening, said system comprising:

(A) a housing for mounting to said container;

(B) a unitary, resiliently flexible, molded valve array structure for being sealingly disposed in said housing on a container over the container opening, said valve array structure having an exterior side adapted to face outwardly away from the interior of said container over which said valve array structure can be disposed and an interior side facing toward said container, said valve array structure including (1) an impervious membrane having an outer periphery surrounding a generally planar region; and (2) a plurality of resiliently flexible, slit valves molded unitary with said membrane and arranged within said outer periphery of said membrane to project out of said planar region, each said valve having a normally closed dispensing orifice which opens when the pressure in the interior of said container exceeds the pressure on the exterior of the valve by a predetermined amount; and (C) an inner retainer located on said interior side of said valve array structure and engaged with said housing to retain said valve array structure within said housing, said inner retainer having at least one opening for establishing communication between the interior of said container and said interior side of said valve array structure.

20. The dispensing system in accordance with claim 19 in which said valve array structure is molded from a thermosetting elastomer.

21. The dispensing system in accordance with claim 19 in which said valve array structure outer periphery has a circular outer edge.

22. The dispensing system in accordance with claim 21 in which said valve array structure includes an annular region of said membrane which (1) lies radially beyond, and circumscribes, said valves, (2) extends to said circular outer edge.

23. The dispensing system in accordance with claim 19 in which said valve array structure includes three of said valves arranged equidistantly from one another.

24. The dispensing system in accordance with claim 19 in which said valves are located in a generally planar array to dispense product from said container along generally parallel discharge paths.

25. The dispensing system in accordance with claim 19 in which said valves all have the identical configuration and size.

26. The dispensing system in accordance with claim 19 in which at least one of said valves is a self-closing valve which closes when the pressure on the exterior of the valve exceeds the pressure in the interior of said container by a predetermined amount.

27. The dispensing system in accordance with claim 19 in which said system is a dispensing closure that is separate from, but releasably attachable to, said container around said opening.

28. The dispensing system in accordance with claim 27 in which said dispensing system includes an outer retainer engaged with said housing to retain said valve array structure within said housing.

29. The dispensing system in accordance with claim 19 in which said closure housing includes an annular channel; and said inner retainer includes a peripheral portion adapted to be received in said channel in a snap-fit engagement.

30. A dispensing system for dispensing a product from a container having an opening, said system comprising:

(A) a housing for mounting said container;

(B) a unitary, resiliently flexible, molded valve array structure for being sealingly disposed in said housing on a container over the container opening, said valve array structure having an exterior side adapted to face outwardly away from the interior of said container over which said valve array structure can be disposed and an interior side facing toward said container, said valve array structure including (1) an impervious membrane having an outer periphery; and (2) a plurality of resiliently flexible, slit valves molded unitary with said membrane and arranged within said outer periphery of said membrane, each said valve having a normally closed dispensing orifice which opens when the pressure in the interior of said container exceeds the pressure on the exterior of the valve by a predetermined amount, and (C) an inner retainer engaged with said housing adjacent said valve to retain said valve array structure within said housing, said inner retainer having at least one opening for establishing communication between the interior of said container and said interior side of said valve array structure;

said housing including a central end wall defining a plurality of circular openings each aligned in registration with a different one of said valves;

said housing including at least one projection extending from said central end wall; and said valve array structure defining at least one aperture for receiving said at least one projection to establish a keyed relationship between said housing and said valve array structure to provide a predetermined orientation of said housing openings with said valves to defines said aligned registration of said housing openings and valves.

31. The dispensing system in accordance with claim 30 in which said projection has a distal end that extends completely through, and beyond, said valve array structure; and said inner retainer defines at least one recess for receiving the distal end of said at least one projection to establish a keyed relationship between said retainer, said valve array structure, and said housing.

32. A dispensing system for dispensing a product from a container having an opening, said system comprising:

(A) a housing for mounting said container;

(B) a unitary, resiliently flexible, molded valve array structure for being sealingly disposed in said housing on a container over the container opening, said valve array structure having an exterior side adapted to face outwardly away from the interior of said container over which said valve array structure can be disposed and an interior side facing toward said container, said valve array structure including (1) an impervious membrane having an outer periphery; and (2) a plurality of resiliently flexible, slit valves molded unitary with said membrane and arranged within said outer periphery of said membrane, each said valve having a normally closed dispensing orifice which opens when the pressure in the interior of said container exceeds the pressure on the exterior of the valve by a predetermined amount; and (C) an inner retainer engaged with said housing adjacent said valve to retain said valve array structure within said housing, said inner retainer having at least one opening for establishing communication between the interior of said container and said interior side of said valve array structure;

said inner retainer including a support deck for supporting said membrane of said valve structure array;

said support deck defining a plurality of circular openings each aligned in registration with a different one of said valves; and each said valve including a portion received in, and extending beyond, one of said support deck openings.

33. A dispensing system for dispensing a product from a container having an opening, said system comprising:

(A) a housing for mounting to said container;

(B) a unitary, resiliently flexible, molded valve array structure for being sealingly disposed in said housing on a container over the container opening, said valve array structure having an exterior side adapted to face outwardly away from the interior of said container over which said valve array structure can be disposed and an interior side facing toward said container, said valve array structure including (1) an impervious membrane having an outer periphery surrounding a generally planar region; and (2) a plurality of resiliently flexible, slit valves molded unitary with said membrane and arranged within said outer periphery of said membrane to project out of said planar region, each said valve having a normally closed dispensing orifice which opens when the pressure in the interior of said container exceeds the pressure on the exterior of the valve by a predetermined amount; and (C) an inner retainer located on said interior side of said valve array structure and engaged with said housing to retain said valve array structure within said housing, said inner retainer having at least one opening for establishing communication between the interior of said container and said interior side of said valve array structure;

said valve array structure including an annular flange having a dovetail cross-section defining an outer surface and an inner surface;

said closure housing having a central opening surrounded by an annular, frustoconical clamping surface engaging said outer surface of said valve array structure flange; and said inner retainer having an annular, frustoconical clamping surface engaging said inner surface of said valve array structure flange.

34. A dispensing system for dispensing a product from a container having an opening, said system comprising:

(A) a housing for mounting to said container;

(B) a unitary, resiliently flexible, molded valve array structure for being sealingly disposed in said housing on a container over the container opening, said valve array structure having an exterior side adapted to face outwardly away from the interior of said container over which said valve array structure can be disposed and an interior side facing toward said container, said valve array structure including (1) an impervious membrane having an outer periphery surrounding a generally planar region; and (2) a plurality of resiliently flexible, slit valves molded unitary with said membrane and arranged within said outer periphery of said membrane to project out of said planar region, each said valve having a normally closed dispensing orifice which opens when the pressure in the interior of said container exceeds the pressure on the exterior of the valve by a predetermined amount; and (C) an inner retainer located on said interior side of said valve array structure and engaged with said housing to retain said valve array structure within said housing, said inner retainer having at least one opening for establishing communication between the interior of said container and said interior side of said valve array structure;

said valve array structure including a central stiffening post having a distal end; and said inner retainer including (1) an annular wall, (2) a plurality of support arms extending radially inwardly from said annular wall, and (3) a central ring that is supported by said support arms and that receives said distal end of said stiffening post.

35. A dispensing system for dispensing a product from a container having an opening, said system comprising:

(A) a housing for mounting said container;

(B) a unitary, resiliently flexible, molded valve array structure for being sealingly disposed in said housing on a container over the container opening, said valve array structure having an exterior side adapted to face outwardly away from the interior of said container over which said valve array structure can be disposed and an interior side facing toward said container, said valve array structure including (1) an impervious membrane having an outer periphery; and (2) a plurality of resiliently flexible, slit valves molded unitary with said membrane and arranged within said outer periphery of said membrane, each said valve having a normally closed dispensing orifice which opens when the pressure in the interior of said container exceeds the pressure on the exterior of the valve by a predetermined amount; and (C) an inner retainer engaged with said housing adjacent said valve to retain said valve array structure within said housing, said inner retainer having at least one opening for establishing communication between the interior of said container and said interior side of said valve array structure;

said valve array structure defining a central aperture; and said inner retainer including (1) an annular wall, (2) a plurality of support arms extending radially inwardly from said annular wall, and (3) a central post having a distal end extending from said support arms into said central aperture of said valve array structure to engage said valve array structure and stiffen said valve array structure.

36. The dispensing system in accordance with claim 35 in which said inner retainer includes an enlarged head at said distal end of said central post for being received on said exterior side of said valve array structure.

* * * * *